US008596637B2

(12) United States Patent
Ogawa

(10) Patent No.: US 8,596,637 B2
(45) Date of Patent: Dec. 3, 2013

(54) SHEET CONVEYING DEVICE, PRINT SYSTEM, AND SHEET COOLING METHOD

(75) Inventor: Tetsuya Ogawa, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 289 days.

(21) Appl. No.: 13/231,233

(22) Filed: Sep. 13, 2011

(65) Prior Publication Data

US 2012/0063790 A1 Mar. 15, 2012

(30) Foreign Application Priority Data

Sep. 14, 2010 (JP) ..... 2010-205883
Dec. 7, 2010 (JP) ..... 2010-272967

(51) Int. Cl.

| | |
|---|---|
| ***B65H 39/10*** | (2006.01) |
| ***G03G 21/20*** | (2006.01) |
| ***G03G 15/20*** | (2006.01) |
| ***G03G 15/00*** | (2006.01) |

(52) U.S. Cl.

USPC ..... 271/302; 271/303; 271/264; 399/92; 399/341; 399/405

(58) Field of Classification Search

USPC ..... 271/302, 303, 264, 189; 399/91, 92, 399/341, 405

See application file for complete search history.

(56) References Cited

U.S. PATENT DOCUMENTS

| | | | | |
|---|---|---|---|---|
| 6,460,844 | B1 * | 10/2002 | Clifford et al. | 271/9.13 |
| 7,616,921 | B2 * | 11/2009 | Shida et al. | 399/341 |
| 7,703,768 | B2 * | 4/2010 | Tamura et al. | 271/264 |
| 8,478,181 | B2 * | 7/2013 | Ichikawa | 399/341 |
| 2006/0285900 | A1 * | 12/2006 | Kurita | 399/361 |
| 2007/0102875 | A1 * | 5/2007 | Maierhofer et al. | 271/302 |
| 2010/0272456 | A1 * | 10/2010 | Kurita | 399/45 |
| 2011/0110678 | A1 * | 5/2011 | Nishikawa | 399/92 |

FOREIGN PATENT DOCUMENTS

| | | |
|---|---|---|
| JP | 2004-252045 | 9/2004 |
| JP | 2006-176309 | 7/2006 |
| JP | 3840369 | 8/2006 |
| JP | 2007-79151 | 3/2007 |
| JP | 2009-265349 | 11/2009 |

* cited by examiner

*Primary Examiner* — Patrick Cicchino
(74) *Attorney, Agent, or Firm* — Oblon, Spivak, McClelland, Maier & Neustadt, L.L.P.

(57) ABSTRACT

A sheet conveying device that conveys a sheet discharged from an image forming apparatus. The sheet conveying device includes an air intake fan that takes in external air; an air exhaust fan that discharges internal air; a plurality of branched conveying paths which are branched from a conveying path within a range from a sheet entrance to a sheet exit and for which a passing time of the sheet is approximately the same; a conveyance motor that independently conveys the sheet to each one of the branched conveying paths; a conveying path switching unit that switches among the branched conveying paths; and a conveying path control unit that causes the conveying path switching unit to sequentially switch among the branched conveying paths every time the sheet is input from the image forming apparatus.

19 Claims, 24 Drawing Sheets

FIG.10

| | RATIO OF SHEET DETECTING TIME | RATIO OF SHEET NON-DETECTING TIME |
|---|---|---|
| TRAVELING SENSOR 3 | 80% | 20% |
| TRAVELING SENSOR 14a | 80% | 20% |
| TRAVELING SENSOR 14b | 80% | 20% |
| TRAVELING SENSOR 14c | 80% | 20% |
| TRAVELING SENSOR 18a | 80% | 20% |
| TRAVELING SENSOR 18b | 80% | 20% |
| TRAVELING SENSOR 18c | 80% | 20% |
| TRAVELING SENSOR 18d | 80% | 20% |

FIG. 12

| | RATIO OF SHEET DETECTING TIME | RATIO OF SHEET NON-DETECTING TIME |
|---|---|---|
| TRAVELING SENSOR 3 | 80% | 20% |
| TRAVELING SENSOR 14a | 26.7% | 73.3% (53.3% UP) |
| TRAVELING SENSOR 14b | 26.7% | 73.3% (53.3% UP) |
| TRAVELING SENSOR 14c | 26.7% | 73.3% (53.3% UP) |
| TRAVELING SENSOR 15a | 26.7% | 73.3% (53.3% UP) |
| TRAVELING SENSOR 15b | 26.7% | 73.3% (53.3% UP) |
| TRAVELING SENSOR 15c | 26.7% | 73.3% (53.3% UP) |
| TRAVELING SENSOR 16a | 26.7% | 73.3% (53.3% UP) |
| TRAVELING SENSOR 16b | 26.7% | 73.3% (53.3% UP) |
| TRAVELING SENSOR 16c | 26.7% | 73.3% (53.3% UP) |
| TRAVELING SENSOR 18a | 80% | 20% |
| TRAVELING SENSOR 18b | 80% | 20% |
| TRAVELING SENSOR 18c | 80% | 20% |
| TRAVELING SENSOR 18d | 80% | 20% |

() ILLUSTRATES % UP AMOUNT OF HEAT DISSIPATION EFFECT OF COOLING PATH FROM FIG. 10

FIG.14

| | RATIO OF SHEET DETECTING TIME | RATIO OF SHEET NON-DETECTING TIME |
|---|---|---|
| TRAVELING SENSOR 3 | 80% | 20% |
| TRAVELING SENSOR 14a | 53.3% | 46.7% (26.7% UP) |
| TRAVELING SENSOR 14b | 53.3% | 46.7% (26.7% UP) |
| TRAVELING SENSOR 14c | 26.7% | 73.3% (53.3% UP) |
| TRAVELING SENSOR 15a | 53.3% | 46.7% (26.7% UP) |
| TRAVELING SENSOR 15b | 53.3% | 46.7% (26.7% UP) |
| TRAVELING SENSOR 15c | 26.7% | 73.3% (53.3% UP) |
| TRAVELING SENSOR 16a | 53.3% | 46.7% (26.7% UP) |
| TRAVELING SENSOR 16b | 53.3% | 46.7% (26.7% UP) |
| TRAVELING SENSOR 16c | 26.7% | 73.3% (53.3% UP) |
| TRAVELING SENSOR 18a | 80% | 20% |
| TRAVELING SENSOR 18b | 80% | 20% |
| TRAVELING SENSOR 18c | 80% | 20% |
| TRAVELING SENSOR 18d | 80% | 20% |

() ILLUSTRATES % UP AMOUNT OF HEAT DISSIPATION EFFECT OF COOLING PATH FROM FIG. 10

FIG.16

| | RATIO OF SHEET DETECTING TIME | RATIO OF SHEET NON-DETECTING TIME |
|---|---|---|
| TRAVELING SENSOR 3 | 80% | 20% |
| TRAVELING SENSOR 14a | 40% | 60% (40% UP) |
| TRAVELING SENSOR 14b | 53.3% | 46.7% (26.7% UP) |
| TRAVELING SENSOR 14c | 40% | 60% (40% UP) |
| TRAVELING SENSOR 15a | 40% | 60% (40% UP) |
| TRAVELING SENSOR 15b | 53.3% | 46.7% (26.7% UP) |
| TRAVELING SENSOR 15c | 40% | 60% (40% UP) |
| TRAVELING SENSOR 16a | 40% | 60% (40% UP) |
| TRAVELING SENSOR 16b | 53.3% | 46.7% (26.7% UP) |
| TRAVELING SENSOR 16c | 40% | 60% (40% UP) |
| TRAVELING SENSOR 18a | 80% | 20% |
| TRAVELING SENSOR 18b | 80% | 20% |
| TRAVELING SENSOR 18c | 80% | 20% |
| TRAVELING SENSOR 18d | 80% | 20% |

() ILLUSTRATES % UP AMOUNT OF HEAT DISSIPATION EFFECT OF COOLING PATH FROM FIG. 10

FIG.18

| | RATIO OF SHEET DETECTING TIME | RATIO OF SHEET NON-DETECTING TIME |
|---|---|---|
| TRAVELING SENSOR 3 | 80% | 20% |
| TRAVELING SENSOR 14a | 53.3% | 46.7% (26.7% UP) |
| TRAVELING SENSOR 14b | 53.3% | 46.7% (26.7% UP) |
| TRAVELING SENSOR 14c | 26.7% | 73.3% (53.3% UP) |
| TRAVELING SENSOR 15a | 26.7% | 73.3% (53.3% UP) |
| TRAVELING SENSOR 15b | 53.3% | 46.7% (26.7% UP) |
| TRAVELING SENSOR 15c | 53.3% | 46.7% (26.7% UP) |
| TRAVELING SENSOR 16a | 53.3% | 46.7% (26.7% UP) |
| TRAVELING SENSOR 16b | 53.3% | 46.7% (26.7% UP) |
| TRAVELING SENSOR 16c | 26.7% | 73.3% (53.3% UP) |
| TRAVELING SENSOR 18a | 80% | 20% |
| TRAVELING SENSOR 18b | 80% | 20% |
| TRAVELING SENSOR 18c | 80% | 20% |
| TRAVELING SENSOR 18d | 80% | 20% |

() ILLUSTRATES % UP AMOUNT OF HEAT DISSIPATION EFFECT OF COOLING PATH FROM FIG. 10

FIG.22

| | RATIO OF SHEET DETECTING TIME | RATIO OF SHEET NON-DETECTING TIME |
|---|---|---|
| TRAVELING SENSOR 3 | 80% | 20% |
| TRAVELING SENSOR 14a | 26.7% | 73.3% (53.3% UP) |
| TRAVELING SENSOR 14b | 26.7% | 73.3% (53.3% UP) |
| TRAVELING SENSOR 14c | 26.7% | 73.3% (53.3% UP) |
| TRAVELING SENSOR 15a | 13.3% | 86.7% (66.7% UP) |
| TRAVELING SENSOR 15b | 13.3% | 86.7% (66.7% UP) |
| TRAVELING SENSOR 15c | 13.3% | 86.7% (66.7% UP) |
| TRAVELING SENSOR 16a | 40% | 60% (40% UP) |
| TRAVELING SENSOR 16b | 40% | 60% (40% UP) |
| TRAVELING SENSOR 16c | 40% | 60% (40% UP) |
| TRAVELING SENSOR 18a | 80% | 20% |
| TRAVELING SENSOR 18b | 80% | 20% |
| TRAVELING SENSOR 18c | 80% | 20% |
| TRAVELING SENSOR 18d | 80% | 20% |

| PASSING TIME OF SHEET | 25 t |
|---|---|

() ILLUSTRATES % UP AMOUNT OF HEAT DISSIPATION EFFECT OF COOLING PATH FROM FIG. 10

FIG.24

PATH SWITCHING DATA

| | D1 | D2 |
|---|---|---|
| BRANCHED COOLING PATH 7 | 2 | 1 |
| BRANCHED COOLING PATH 8 | 1 | 3 |
| BRANCHED COOLING PATH 8 | 3 | 4 |

D3 2+1+3=6

D1: SHEET DISTRIBUTION RATIO
D2: NUMBER OF TIMES OF SWITCHING PAGE COUNTER
D3: NUMBER OF PAGES AT WHICH PAGE COUNTER IS RETURNED TO "0"

SHEET CONVEYING DEVICE, PRINT SYSTEM, AND SHEET COOLING METHOD

CROSS-REFERENCE TO RELATED APPLICATIONS

The present application claims priority to and incorporates by reference the entire contents of Japanese Patent Application No. 2010-205883 filed in Japan on Sep. 14, 2010 and Japanese Patent Application No. 2010-272967 filed in Japan on Dec. 07, 2010.

BACKGROUND OF THE INVENTION

1. Field of the Invention

The present invention relates to a sheet conveying device that conveys a sheet discharged from an image forming apparatus, a print system, and a sheet cooling method.

2. Description of the Related Art

In image forming apparatuses using electrophotography, when a sheet on which a toner image is transferred passes through a fixing unit, toner transferred onto the sheet is fused and is tightly contact with the sheet so as to be fixed thereto. Although the sheet is conveyed while being naturally cooled after the sheet passes through the fixing unit, the surface temperature of the sheet continues to be high after the sheet passes through the fixing unit.

The toner fixed to the sheet has adherence until it is cooled. Accordingly, under an undesirable condition, when the sheets are loaded in a discharging unit, a phenomenon called a toner blocking phenomenon occurs, such as the adhesion of toner to a sheet face on which loaded sheets overlap each other or toner peel-off at the time of separating sheets.

The undesired condition refers to a case where sheets are consecutively conveyed without any intermission, a case where a large quantity of sheets is loaded in the loading unit (a case where the airtightness at the time of overlapping sheets is high or a case where there are many sheets loaded into the loading unit so that pressure is applied to the sheets), a case where toner images are fixed to both faces of a sheet, a case where the fixing temperature is set to be high, a case where the environmental temperature or the environmental humidity is high, a case where a sheet of a type that has a low degree of toner fixation is used, a case where sheets are loaded in the loading unit for a long time, or the like.

A. In order to prevent such a blocking phenomenon, various means for cooling sheets have been devised until now. FIG. 1 is a diagram illustrating an overview of a conventional cooling conveyance device. The cooling conveyance device includes: a conveying path that is arranged on the downstream of an image forming process and has a "U" shape for cooling sheets; air intake fans (the top face and the bottom face) that take in the external air; and an air exhaust fan (the rear face of the cooling conveyance device when viewed from the surface of paper) that discharges the air inside the cooling conveyance device to the outside of the device.

A sheet conveyed from the image forming apparatus is conveyed while being in contact with a metal plate arranged in the conveying path for cooling, whereby the temperature thereof decreases. The metal plate, which is arranged in the conveying path of the cooling conveyance device and comes to bear heat due to the passage of the sheet, is designed so as to be cooled by receiving a wind blowing from the air intake fan and maintain the cooling effect of the sheet. In other words, as long as the sheets are conveyed one by one with a sufficient gap maintained therebetween, the metal plate is cooled by the wind generated by the air intake fan, and accordingly, the metal plate can cool the sheets to the extent that the toner blocking phenomenon does not occur.

In addition, on the downstream of the cooling conveyance device, a stacker is arranged so that the sheets can be stacked there.

B. In addition, in order to suppress the toner blocking phenomenon of the loaded sheets, a cooling method is proposed in which a sheet is cooled by temporarily stopping or decelerating the sheet on the conveying path of the cooling device (for example, see Japanese Patent Application Laid-Open (JP-A) No. 2007-079151).

C. Furthermore, for the purpose of cooling a conveyed sheet, a cooling method is proposed in which two lines of conveying paths for duplex printing are included, and the conveyed sheet is cooled by alternately using the conveying paths (for example, see JP-A No. 2009-265349). According to such a conventional technique, in a case where a sheet heated by a fixing unit is supplied to the image forming unit in a state of not being sufficiently cooled, the temperature of toner disposed inside the developing unit increases due to heat dissipated from the sheet so that the chargeability degrades and an image abnormality such as a thin image density occurs. Accordingly, in order to prevent such an image abnormality, the sheet, which has passed the fixing unit, is cooled in the conveying path, the cooled sheet is conveyed to a transfer unit again, toner is transferred to the sheet, and then the sheet passes through the fixing unit.

However, according to the cooling method represented in A, in a case where the above-described condition is extremely, or a plurality of the above conditions is set simultaneously, when the sheets are conveyed sequentially, heat gradually accumulates in the metal plate disposed in the conveying path, and accordingly, the cooling effect may be degraded. Accordingly, there is a problem in that the toner blocking phenomenon of loaded sheets may occur. A case may be considered in which the conveyance interval of sheets may be set to be wide enough to maintain the cooling effect. However, in such a method, since it is difficult to sequentially convey the sheets, the productivity decreases.

In addition, according to the cooling method represented in B, although it is sure that the sheets can be cooled easily, it is difficult to sequentially convey the sheets in the cooling conveyance method in which the sheet is stopped or decelerated. Accordingly there is a problem in that the productivity decreases.

Furthermore, according to the cooling method represented in C, the sheet can be cooled during a period until the rear face is printed after the front face is printed. However, after the rear face is printed, the sheet does not pass through the conveying path that is used for cooling. Accordingly, the sheet with a high temperature is conveyed to the loading unit, and therefore, there is a problem in that the toner blocking phenomenon of loaded sheets occurs.

Besides the methods represented in A, B, and C, further technique may be considered in which two conveying paths having different lengths are arranged in a cooling conveyance device, and a sheet is conveyed along a longer conveying path under a condition that the toner blocking phenomenon may easily occur. However, a way of merely using a long conveying path may lead to the decreased cooling capability of the metal plate soon as sheets are sequentially conveyed, and hence the toner blocking phenomenon may occur.

SUMMARY OF THE INVENTION

It is an object of the present invention to at least partially solve the problems in the conventional technology.

According to an aspect of the present invention, there is provided a sheet conveying device that conveys a sheet discharged from an image forming apparatus. The sheet conveying device includes an air intake fan that takes in external air; an air exhaust fan that discharges internal air; a plurality of branched conveying paths which are branched from a conveying path within a range from a sheet entrance to a sheet exit and for which a passing time of the sheet is approximately the same; a conveyance motor that independently conveys the sheet to each one of the branched conveying paths; a conveying path switching unit that switches among the branched conveying paths; and a conveying path control unit that causes the conveying path switching unit to sequentially switch among the branched conveying paths every time the sheet is input from the image forming apparatus.

According to another aspect of the present invention, there is provided a print system that includes an image forming apparatus; and a sheet conveying device that conveys a sheet discharged from the image forming apparatus. The sheet conveying device includes an air intake fan that takes in external air; an air exhaust fan that discharges internal air; a plurality of branched conveying paths which are branched from a conveying path within a range from a sheet entrance to a sheet exit and for which a passing time of the sheet is approximately the same; a conveyance motor that independently conveys the sheet to each one of the branched conveying paths; a conveying path switching unit that switches among the branched conveying paths; and a conveying path control unit that causes the conveying path switching unit to sequentially switch among the branched conveying paths every time the sheet is input from the image forming apparatus. The image forming apparatus includes a conveying path determining unit that determines the branched conveying path on which the sheet is to be conveyed; and a transmission unit that transmits an instruction for the determined branched conveying path to the sheet conveying device.

According to still another aspect of the present invention, there is provided a sheet cooling method performed in a sheet conveying device that includes an air intake fan that takes in external air; an air exhaust fan that discharges internal air; a plurality of branched conveying paths which are branched from a conveying path within a range from a sheet entrance to a sheet exit and for which a passing time of the sheet is approximately the same; a conveyance motor that independently conveys the sheet on each one of the branched conveying paths; and a conveying path switching unit that switches among the branched conveying paths. The method includes causing the conveying path switching unit to sequentially switch among the branched conveying paths every time the sheet is input from the image forming apparatus by using a conveying path control unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 10 is an example of a diagram illustrating the ratio between a sheet detecting time and a sheet non-detecting time in numeric values in the timing chart diagram illustrated in FIG. 9;

FIG. 12 is an example of a diagram that illustrates the relation between the ratio of a sheet detecting time and the ratio of a sheet non-detecting time for each traveling sensor in a case where the timing chart illustrated in FIG. 11 is employed;

FIG. 14 is a diagram that illustrates the relation between the ratio of a sheet detecting time and the ratio of a sheet non-detecting time for each traveling sensor in a case where the timing chart illustrated in FIG. 13 is employed;

FIG. 16 is a diagram that illustrates the relation between the ratio of a sheet detecting time and the ratio of a sheet non-detecting time for each traveling sensor in a case where the timing chart illustrated in FIG. 15 is employed;

FIG. 18 is a diagram that illustrates the relation between the ratio of a sheet detecting time and the ratio of a sheet non-detecting time for each traveling sensor in a case where the timing chart illustrated in FIG. 17 is employed;

FIG. 22 is a diagram that illustrates the relation between the ratio of a sheet detecting time and the ratio of a sheet non-detecting time for each traveling sensor in a case where the timing chart illustrated in FIG. 21 is employed;

FIG. 24 is a schematic diagram illustrating an example of path switching data.

DETAILED DESCRIPTION OF THE PREFERRED EMBODIMENTS

Hereinafter, exemplary embodiments of the invention will be described with the accompanying drawings.

First Embodiment

Figure 1:
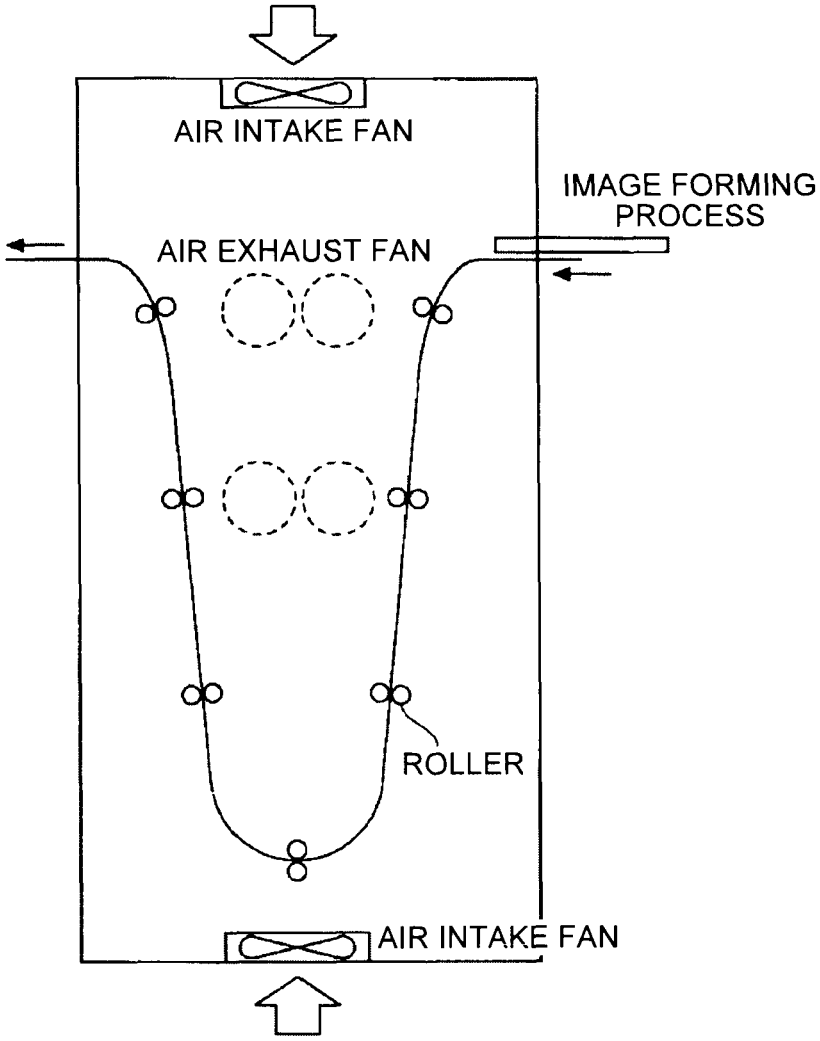
FIG. 1 is an example of a diagram illustrating an overview of a conventional cooling conveyance device.
Figure 2:
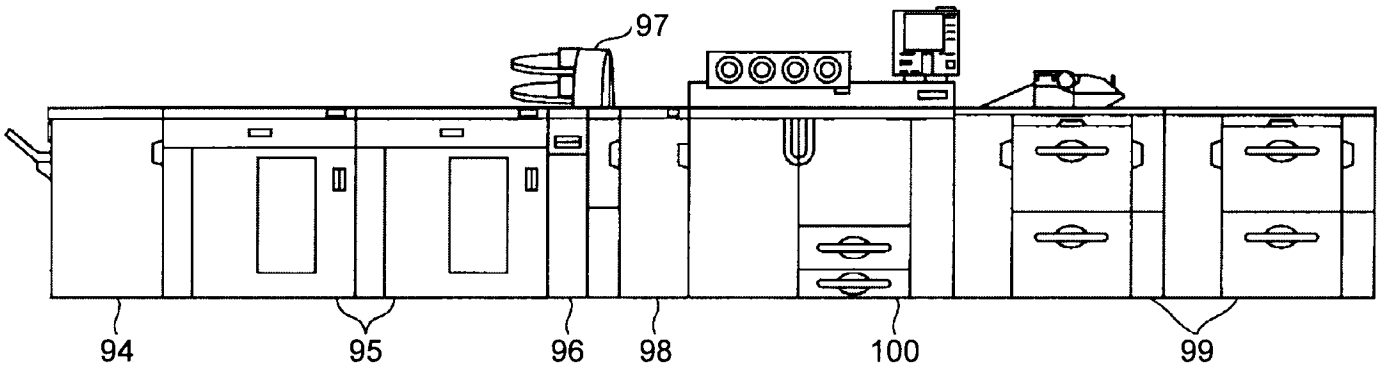
FIG. 2 is an example of an exterior view of a cooling conveyance device that is connected to an image forming apparatus.

FIG. 2 is an example of an exterior view of a cooling conveyance device 98 that is connected to an image forming apparatus 100 according to a first embodiment. To the image forming apparatus 100, various options are connected. The cooling conveyance device 98 is one of the options. Various options are not essential from the viewpoint of image forming, and the simplest configuration is a configuration in which the image forming apparatus 100 is present alone. However, by connecting such options thereto, the productivity can be improved. A system acquired by connecting one or more options to the image forming apparatus 100 is referred to as a print system 300.

Although the image forming apparatuses 100, at first, are widely used in general offices and the like, recently, by utilizing the strong points of the correspondence to a small lot and variable printing (printing variable data to a leaflet, a direct mail, or the like), the image forming apparatuses 100 are started to be used in a production market (a commercial printing market or a corporate printing market) as well in which offset printing machines have been mainly used until now.

Although the printing system of the image forming apparatus 100 used for production printing is electrophotography, which is the same as that of the image forming apparatus 100 used for an office, the image forming apparatus 100 used for production printing frequently performs printing for a large quantity of transfer paper sheets, and the printing materials thereof are goods, whereby the image quality is more important in many cases. Accordingly, the diameter of a photosensitive element of the image forming apparatus 100 used for production printing is larger than that of the image forming apparatus 100 used for an office, and the photosensitive body rotates at a speed higher than that of the image forming apparatus use for an office. In addition, since the supplies of the image forming apparatus 100 used for production printing are consumed faster than those of the image forming apparatus 100 for an office, a high-capacity feeding device, a high-capacity toner supplying device, and the like are installed thereto. Furthermore, in order to perform bookbinding or the like for sheets after printing in accordance with a user need, various options can be connected to the downstream process.

In addition, although the image forming apparatus 100 may have a function of forming an image on a sheet, the image forming apparatus 100 may be a multifunction peripheral (MFP) that includes one or more of a copying function, a scanner function, and a facsimile function.

The options will be described in brief. A feeding tray unit 99 is a dedicated feeding device that is used for loading a high capacity of transfer paper sheets. An insert feeder 97 is a device that inserts a front sheet, a rear sheet, and an insertion sheet between transfer paper sheets. A Z folding unit 96 is a device that performs Z folding of transfer paper sheets. A stacker 95 is a device that can load transfer paper sheets after printing (after binding) and convey the transfer paper sheets by a truck. A finisher 94 is a device that stacks transfer paper sheets while aligning the transfer paper sheets. In addition, as other options, there are a middle stitching unit (performs middle stitching of a plurality of transfer paper sheets, for example, by using a staple), a ring binder, and the like.

The cooling conveyance device 98 is a device that has a main feature portion according to this embodiment and is a device that is used for cooling a sheet on which an image is formed.

Overview of Features

Figure 3:
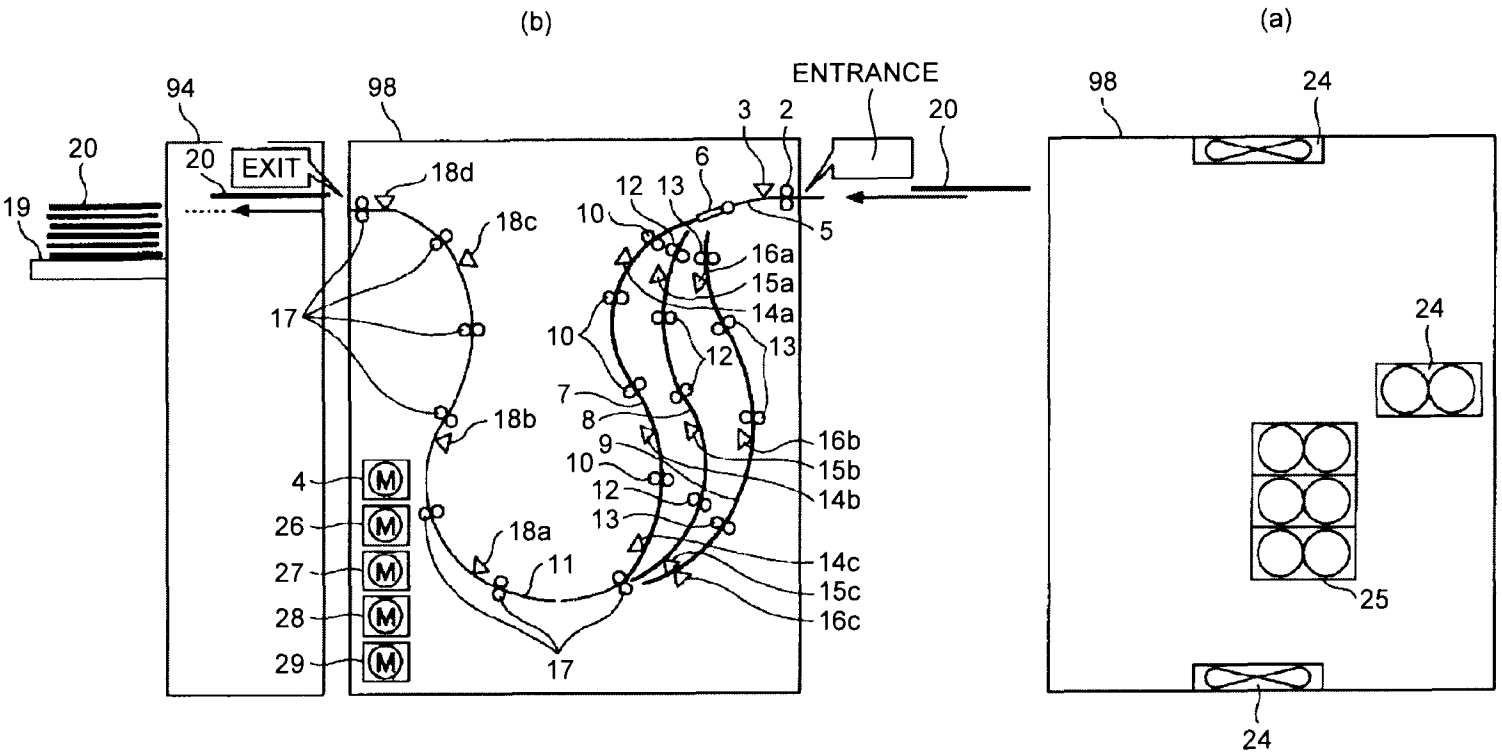
FIG. 3 is an example of a schematic diagram illustrating a cooling conveyance device.

FIG. 3 is an example of a schematic diagram illustrating the cooling conveyance device 98 according to this embodiment. First, an overview of the features of the cooling conveyance device 98 will be described.

(1) The cooling conveyance device 98 includes a plurality of branched cooling paths 7 to 9 having the same length, and sheets are sequentially conveyed in the branched cooling paths 7 to 9. Roughly speaking, the cooling capacity per unit length is three times the cooling capacity of a case where there is one cooling path (in the case of an ideal state in which the wind generated by the air intake fan is uniform), and the lengths of the branched cooling paths 7 to 9 are the same (the passing time of a sheet is the same), and accordingly, a time interval between sheets when the sheets come out of the branched cooling paths 7 to 9 and join together can be configured to be the same as that of a case where there is one cooling path. Therefore, the productivity does not decrease at all.

In other words, even in a case where sheets are sequentially conveyed to the cooling conveyance device 98 without any interruption, the time density of sheets that are conveyed by one branched cooling path 7 to 9 can be decreased. Accordingly, the heat-dissipation effect of heat accumulated in the branched cooling path 7 to 9 is increased, whereby the cooling effect of the metal plate can be effectively recovered.

(2) Since the plurality of the branched cooling paths 7 to 9 is included, even in a case where a sheet is temporarily stopped, compared to the case where there is one cooling path, a decrease in the productivity can be greatly suppressed.

In other words, when a sheet is temporarily stopped, the cooling time of the sheet can be lengthened, and sheets can enter other branched cooling paths 8 and 9 and be stopped even when a sheet is stopped in one branched cooling path 7, and accordingly, a decrease in the productivity can be suppressed to the stop time only.

Configuration

The cooling conveyance device 98 is connected to the finisher 94. The section (a) of FIG. 3 is a front view of the cooling conveyance device 98 and the finisher 94, and the section (b) of FIG. 3 is a front view illustrating the installation positions of fans of the cooling conveyance device 98. In addition, as illustrated in FIG. 2, various options (a stacker, the middle stitching unit, the Z folding unit, various binding devices, or the like) may be arranged between the finisher 94 and the cooling conveyance device 98.

As illustrated in the section (a) of FIG. 3, the cooling conveyance device 98 includes air intake fans 24 that take external air therein and air exhaust fans 25 that discharge the air present inside the cooling conveyance device 98. A total of three air intake fans 24 are disposed on a top plate, a bottom plate, and a rear face of a housing of the cooling conveyance device 98. In addition, three air exhaust fans 25 are adjacently disposed on the rear face of the cooling conveyance device 98.

Although the installation places and the number of the fans are an example, the higher the temperature of a sheet is, the larger a temperature difference from the external air is, and accordingly, the temperature can be effectively decreased. Accordingly, by disposing the air intake fans 24 on the entrance side of the rear face, external air is blown to the entrance side (the branched cooling paths 7 to 9) inside the cooling conveyance device 98.

The cooling conveyance device 98 includes the branched cooling path 7, the branched cooling path 8, the branched cooling path 9, and a cooling path 11 that dissipate the heat of sheets. The branched cooling path 7, the branched cooling path, 8, the branched cooling path 9, and the cooling path 11 are connected in a "U" shape so as to configure a conveying path. The branched cooling path 7, the branched cooling path 8, and the branched cooling path 9 have a configuration in which the metal plates overlap one another when viewed from the side face (for example, the entrance side).

Since the external air taken in by the air intake fans 24 is constantly blown to the branched cooling path 7, the branched cooling path 8, the branched cooling path 9, and the cooling path 11, the heat of the branched cooling path 7, the branched cooling path 8, the branched cooling path 9, and the cooling path 11 is dissipated, whereby the cooling effect of the metal plates can be maintained. In order to maintain the productivity, it is preferable to form the branched cooling path 7, the branched cooling path 8, and the branched cooling path 9 to have the same physical length. However, the request for configuring the branched cooling paths to have the same length is the same request for configuring the time lengths for a sheet 20 to pass through the branched cooling paths 7 to 9 to be the same. Thus, by adjusting the rotation speeds of conveyance motors 26 to 29, the time for a sheet to pass through the branched cooling path 7, the branched cooling path 8, and the branched cooling path 9 may be configured to be approximately the same.

The air exhaust fans 25 discharge the air present inside the cooling conveyance device 98, which is heated by the heat dissipating of the branched cooling path 7, the branched cooling path 8, the branched cooling path 9, and the cooling path 11, outside the cooling conveyance device 98.

As described above, by branching the entrance-side conveying path 5 into three, sheets can be conveyed in the branched cooling paths 7 to 9 in a state in which a temperature difference between the sheets and the external air is large. Accordingly, the temperature of the sheets can be efficiently decreased.

In addition, as illustrated in FIG. 3, by configuring the joining portion of the three branched cooling paths 7 to 9 to be near the bottom face, all the sheets can pass through the cooling path 11 of the bottom portion in which the sheets can be easily cooled by the air intake fans 24 disposed on the bottom face and the top plate regardless of the branched cooling paths 7 to 9 through which the sheets pass.

However, the configuration illustrated in FIG. 3 does not exclude a form in which the branched cooling paths 7 to 9 are maintained to be branched over the entire conveying path inside the cooling conveyance device 98 or a form in which the branched cooling paths 7 to 9 do not join until they exceed a half from the entrance including a portion near the bottom face. The joining point of the branched cooling paths 7 to 9 may be appropriately designed in accordance with the arrangement of the air intake fans 24 and the air exhaust fans 25.

The cooling conveyance device 98 includes a carriage roller 2 and a conveyance motor 4 that rotates the carriage roller 2, and rotates the carriage roller 2 by driving the conveyance motor 4, thereby conveying a sheet 20 conveyed from the image forming apparatus 100 to the inside of the cooling conveyance device 98. The sheet 20, first, is conveyed in a conveying path 5.

The cooling conveyance device 98 includes a traveling sensor 3 and a path switching gate 6 in front of the carriage roller 2. The path switching gate 6 is a conveying path switching device that selectively connects the conveying path 5 and one of the branched cooling paths 7 to 9.

When the sheet 20 arrives at the traveling sensor 3, the cooling conveyance device 98 changes the conveying path by driving the path switching gate 6 before the sheet 20 arrives at the path switching gate 6 so as to convey the sheet 20 to one of the branched cooling path 7, the branched cooling path 8, and the branched cooling path 9.

The cooling conveyance device 98 drives the path switching gate 6 in accordance with an instruction transmitted from the image forming apparatus 100, and thereby switching among the branched cooling paths, on which the sheet 20 is to be conveyed, in the order of the branched cooling path 7, the branched cooling path 8, and the branched cooling path 9 for each sheet 20. Since switching among the branched cooling paths 7 to 9 is performed "in the order", the branched cooling paths 7 to 9 evenly convey the sheets 20. Here, the number of the branched cooling paths is not limited to three and may be two or four or more.

In addition, the cooling conveyance device 98 may drive the path switching gate 6 in accordance with an instruction transmitted from the image forming apparatus 100, and thereby performing conveyance with the branched cooling path, on which the sheet 20 is to be conveyed, fixed to one of the branched cooling path 7, the branched cooling path 8, and the branched cooling path 9. The instruction transmitted from the image forming apparatus 100 will be described later.

The branched cooling path 7 includes a carriage roller 10 that is driven to rotate by the conveyance motor 26 and a traveling sensor 14, and rotates the carriage roller 10, thereby conveying the sheet 20 to the cooling path 11 located in front of the branched cooling path 7. The branched cooling path 7 provides a conveying path by using one or a plurality of metal plates having high thermal conductivity, and, as a sheet passes through the branched cooling path 7 while being brought into contact therewith, the metal plate takes heat of the sheet 20 away, thereby decreasing the temperature of the sheet 20. In addition, this branched cooling path 7 monitors the position of the sheet 20 by using the traveling sensor 14 and can stop the sheet 20 on the branched cooling path 7 by stopping the rotation of the carriage roller 10 by stopping the driving of the conveyance motor 26.

The cooling conveyance device 98 stops the sheet 20 on the branched cooling path 7 in accordance with an instruction transmitted from the image forming apparatus 100. As the position on the branched cooling path 7 at which the sheet 20 is stopped, the sheet 20 can be stopped at a position at which the sheet 20 is detected by two traveling sensors 14 out of three traveling sensors 14. The stop position will be described later.

In addition, the image forming apparatus 100 instructs the cooling conveyance device 98 to stop the sheet 20 at a position detected by a specific travel sensor, of the positions detected by the three traveling sensors 14.

When the cooling conveyance device 98 is received an instruction on a stop time t from the image forming apparatus 100, the cooling conveyance device 98 stops the sheet 20 on the branched cooling path 7 and resumes the conveyance of the sheet 20 when the instructed stop time t elapses after the stop.

When the cooling conveyance device 98 is instructed that the stop time t is zero (0) by the image forming apparatus 100, not illustrated in the figure, the cooling conveyance device 98 continues to convey the sheet 20 without stopping the sheet 20 on the branched cooling path 7.

The branched cooling path 8 includes a carriage roller 12 that is driven to rotate by the conveyance motor 27 and a traveling sensor 15, and rotates the carriage roller 12, thereby conveying the sheet 20 to the cooling path 11 located in front of the branched cooling path 8.

The branched cooling path 8 provides a conveying path by using one or a plurality of metal plates having high thermal conductivity, and, as a sheet passes through the branched cooling path 8 while being brought into contact therewith, the metal plate takes heat of the sheet 20 away, thereby decreasing the temperature of the sheet 20. In addition, this branched cooling path 8 monitors the position of the sheet 20 by using the traveling sensor 15 and can stop the sheet 20 on the branched cooling path 8 by stopping the rotation of the carriage roller 12 by stopping the driving of the conveyance motor 27.

When the cooling conveyance device 98 is received an instruction on the stop time t from the image forming apparatus 100, the cooling conveyance device 98 stops the sheet 20 on the branched cooling path 8 and resumes the conveyance of the sheet 20 when the instructed stop time t elapses after the stop.

As the position on the branched cooling path 8 at which the sheet 20 is stopped, the sheet 20 can be stopped at a position at which the sheet is detected by two traveling sensors 15 out of three traveling sensors 15. The stop position will be described later.

The image forming apparatus 100 instructs the cooling conveyance device 98 to stop the sheet 20 at a position detected by a specific traveling sensor, of the positions detected by the three traveling sensors 15.

When the cooling conveyance device 98 is instructed that the stop time t is zero (0) by the image forming apparatus 100, the cooling conveyance device 98 continues to convey the sheet 20 without stopping the sheet 20 on the branched cooling path 8.

The branched cooling path 9 includes a carriage roller 13 that is driven to rotate by the conveyance motor 28 and a traveling sensor 16, and rotates the carriage roller 13, thereby conveying the sheet 20 to the cooling path 11 located in front of the branched cooling path 9.

The branched cooling path 9 provides a conveying path by using one or a plurality of metal plates having high thermal conductivity, and, as a sheet 20 passes through the branched cooling path 9 while being brought into contact therewith, the metal plate takes heat of the sheet 20 away, thereby decreasing the temperature of the sheet 20. In addition, this branched cooling path 9 monitors the position of the sheet 20 by using the traveling sensor 16 and can stop the sheet 20 on the branched cooling path 9 by stopping the rotation of the carriage roller 13 by stopping the driving of the conveyance motor 28.

As the position on the branched cooling path 9 at which the sheet 20 is stopped, the sheet 20 can be stopped at a position at which the sheet 20 is detected by two traveling sensors 16 out of three traveling sensors 16. The stop position will be described later.

The image forming apparatus 100 instructs the cooling conveyance device to stop the sheet 20 at a position detected by a specific traveling sensor, of the positions detected by the three traveling sensors 16.

When the cooling conveyance device 98 is received an instruction on a stop time t from the image forming apparatus 100, the cooling conveyance device 98 stops the sheet 20 on the branched cooling path 9 and resumes the conveyance of the sheet 20 when the instructed stop time t elapses after the stop.

When the cooling conveyance device 98 is instructed that the stop time t is zero (0) by the image forming apparatus 100, the cooling conveyance device 98 continues to convey the sheet 20 without stopping the sheet 20 on the branched cooling path 9.

In addition, in order to maintain the productivity, the cooling conveyance device 98 controls the conveyance motors 26, 27, and 28 such that the passing time of the sheet 20 is the same in the branched cooling path 7, the branched cooling path 8, and the branched cooling path 9.

The cooling path 11 includes a carriage roller 17 that is driven to rotate by the conveyance motor 29 and a traveling sensor 18, and rotates the carriage roller 17, thereby conveying the sheet 20 to the finisher 94 located in front of the cooling path 11.

The cooling path 11 provides a conveying path by using one or a plurality of metal plates having high thermal conductivity, and, as a sheet 20 passes through the cooling path 11 while being brought into contact therewith, the metal plate takes heat of the sheet 20 away, thereby decreasing the temperature of the sheet 20.

The finisher 94 includes a loading tray 19 used for loading sheets 20 and loads a sheet 20 cooled by the cooling conveyance device 98 into the loading tray 19.

Stop Position

FIGS. 4A to 4F are examples of diagrams illustrating the stop positions of a sheet 20 in the branched cooling paths 7 to 9.

Figure 4A:
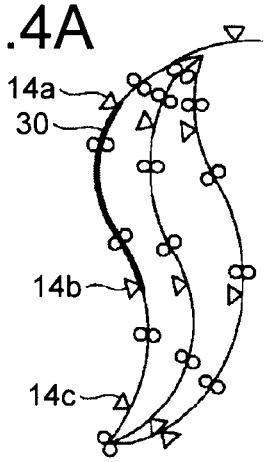
FIGS. 4A to 4F are examples of diagrams illustrating the stop positions of a sheet in branched cooling paths.
Figure 4B:
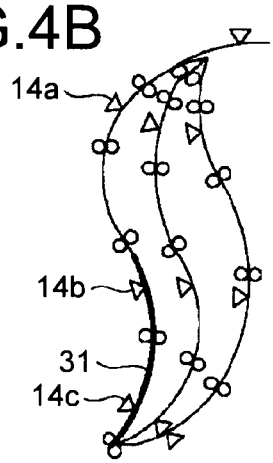
Figure 4C:
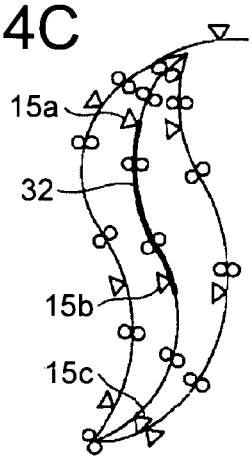
Figure 4D:
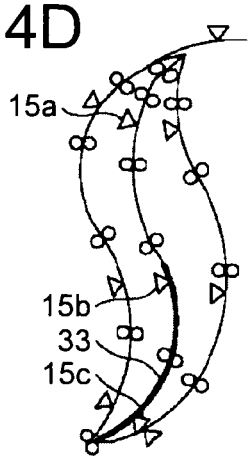
Figure 4E:
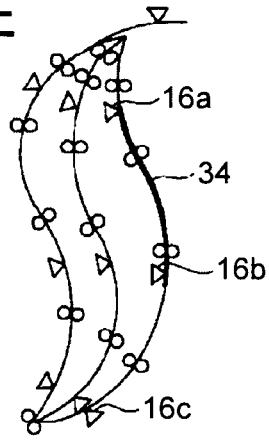
Figure 4F:
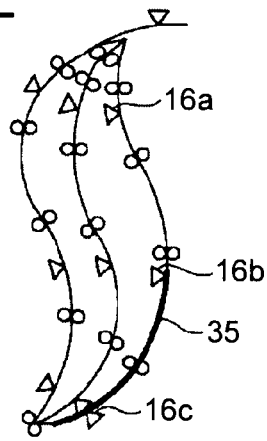

FIGS. 4A and 4B illustrate the stop positions of sheets 20 in the branched cooling path 7, FIGS. 4C and 4D illustrate the stop positions of sheets 20 in the branched cooling path 8, and FIGS. 4E and 4F illustrate the stop positions of sheets 20 in the branched cooling path 9.

Branched Cooling Path 7

The cooling conveyance device 98 can temporarily stop the sheet 20 at a stop position 30 at which the sheet 20 is detected by a traveling sensor 14*a* and a traveling sensor 14*b*.

The cooling conveyance device 98 can stop the sheet 20 at a stop position 31 at which the sheet 20 is detected by the traveling sensor 14*b* and a traveling sensor 14*c*.

The cooling conveyance device 98 can stop the sheet 20 at the stop position 30 or the stop position 31 in the branched cooling path 7 in accordance with an instruction transmitted from the image forming apparatus 100.

Branched Cooling Path 8

The cooling conveyance device 98 can temporarily stop the sheet 20 at a stop position 32 at which the sheet 20 is detected by a traveling sensor 15*a* and a traveling sensor 15*b*.

The cooling conveyance device 98 can stop the sheet 20 at a stop position 33 at which the sheet 20 is detected by the traveling sensor 15*b* and a traveling sensor 15*c*.

The cooling conveyance device 98 can stop the sheet 20 at the stop position 32 or the stop position 33 in the branched cooling path 8 in accordance with an instruction transmitted from the image forming apparatus 100.

Branched Cooling Path 9

The cooling conveyance device 98 can temporarily stop the sheet 20 at a stop position 34 at which the sheet 20 is detected by a traveling sensor 16*a* and a traveling sensor 16*b*.

The cooling conveyance device 98 can stop the sheet 20 at a stop position 35 at which the sheet 20 is detected by the traveling sensor 16*b* and a traveling sensor 16*c*.

The cooling conveyance device 98 can stop the sheet 20 at the stop position 34 or the stop position 35 in the branched cooling path 9 in accordance with an instruction transmitted from the image forming apparatus 100.

Image Forming Apparatus

Figure 5:
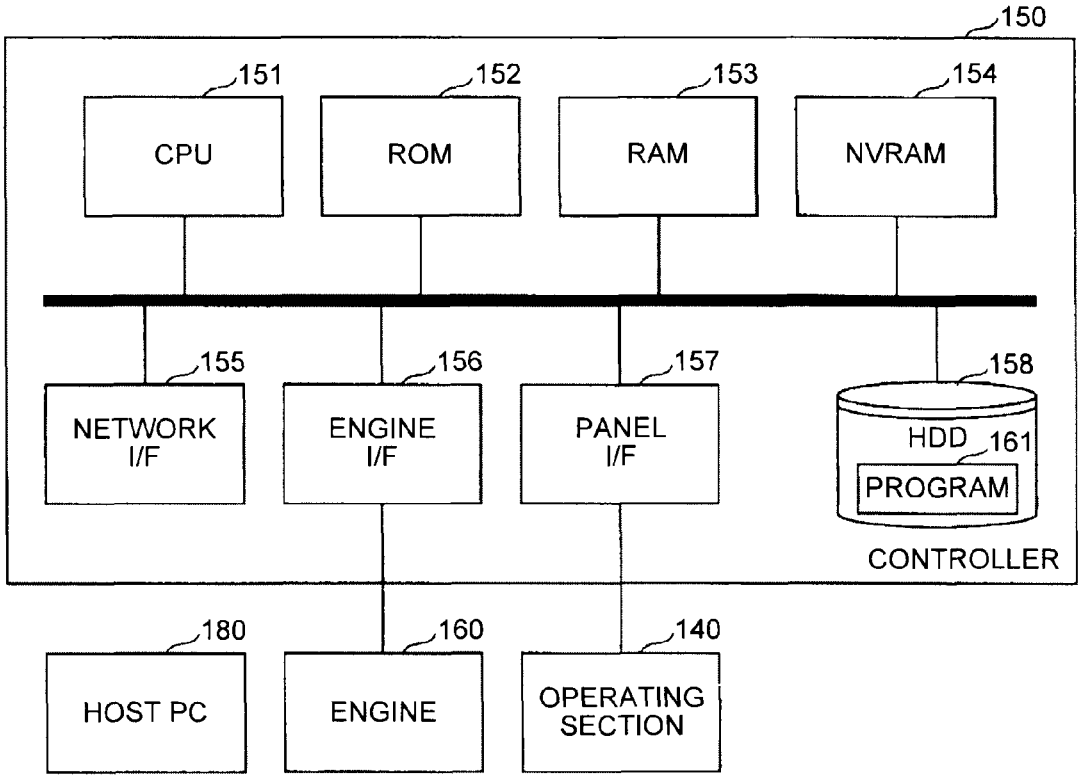
FIG. 5 is an example of a diagram illustrating the hardware configuration of a controller of an image forming apparatus.

FIG. 5 is an example of a diagram illustrating the hardware configuration of a controller 150 of the image forming apparatus 100. The controller 150 of the image forming apparatus 100 has a function as a general computer.

The image forming apparatus 100 includes: the controller 150 that controls the overall operation of the image forming apparatus 100; an engine 160 that is used for printing an image on a sheet; and an operating section 140 that is a user interface for an operator.

The controller 150 includes: a CPU 151; a ROM 152; a RAM 153; an NVRAM 154; a network I/F 155; an engine I/F 156; a panel I/F 157; and an HDD 158.

The ROM 152 stores a start-up program, an initial set value, and the like therein. The RAM 153 is used as a page memory that is generated by the controller 150 or a work memory that is necessary for the operation of software. The NVRAM 154 is a non-volatile memory that stores a printing condition set by the image forming apparatus 100 or the like therein. The network I/F 155 performs data transmission or data reception with a server, which is not shown in the figure, or a host PC 180 that is connected to a network. The engine I/F 156 controls the engine 160 by issuing a printing instruction or the like.

The engine 160 includes a plotter engine that performs at least image formation. In addition, the plotter engine may be an inkjet type. In addition, in the engine 160, a scanner engine and a facsimile engine are included.

The operating section 140 includes an input unit that is used for an operator to operate the image forming apparatus 100 and a display unit. The input unit is configured by hardware keys and various software keys that are displayed on the display unit. In addition, the display unit is a display unit such as a liquid crystal that displays an operation menu or software keys on a GUI screen. On the display unit, a touch panel is integrally arranged and accepts a user's operation of a software key by operator.

The panel I/F 157 controls the input or output of the operating section 140. The HDD 158 is an example of a non-volatile storage unit and may be substituted with a flash memory or the like. In the HDD 158, feature data of this embodiment, which will be described later and a program 161 are stored.

Cooling Conveyance Device

Figure 6:
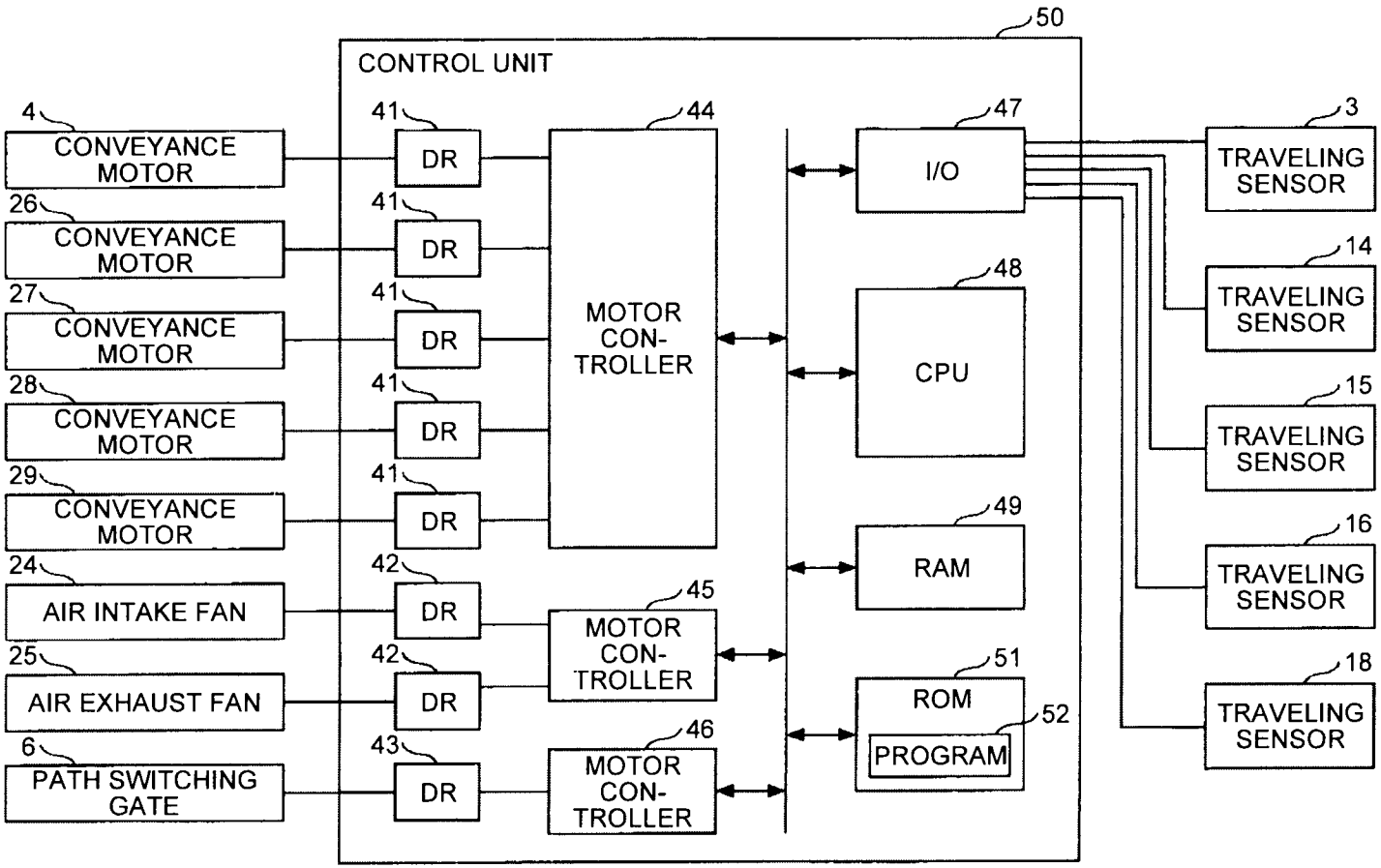
FIG. 6 is an example of a block diagram illustrating a control unit of a cooling conveyance device.

FIG. 6 is an example of a block diagram illustrating a control unit 50 of the cooling conveyance device 98. The control unit 50 of the cooling conveyance device 98 is connected to the conveyance motors 4 and 26 to 29 and the traveling sensors 3, 14 to 16, and 18 that have been described until now. In addition, the control unit 50 has a configuration in which motor controllers 44, 45, and 46, a CPU 48, a RAM 49, a ROM 51, and an I/O 47 are connected to a bus as a general configuration for motor control. Here, for example, although the conveyance motors 4 and 26 to 29 are described as stepping motors, the conveyance motors may be DC motors or the like. In addition, for example, motors that rotate the air intake fans 24 and the air exhaust fans 25 are DC motors.

To the I/O 47, the traveling sensors 3, 14 to 16, and 18 are connected. For example, the traveling sensors 3, 14 to 16, and 18 are optical sensors that detect the passage of a sheet in accordance with a change in the amount of light, convert the amount of light into an electric signal, and transmit the electric signal to the I/O 47. The I/O 47 performs A/D conversion for the electric signal and outputs the converted signal to the CPU 48.

The CPU 48 executes a program 52 stored in the ROM 51 by using the RAM 49 as a work memory. Although the functions of the program 52 will be described later, the program 52 controls driving/stopping of the conveyance motors 4 and 26 to 29 and the connection destination of the path switching gate 6 based on the position of a sheet detected by the traveling sensors 3, 14 to 16, and 18 in accordance with an instruction of the image forming apparatus 100.

The motor controller 44 is received an instruction on a predetermined rotation speed from the CPU 48. The motor controller 44 outputs a pulse signal of a frequency corresponding to the rotation speed to each driver (DR) 41. Each DR 41 generates serial data corresponding to each excitation phase based on the pulse signal and the excitation system, performs a switching process based on the serial data, and controls a current flowing in each excitation phase of the stepping motor.

In addition, in a case where the conveyance motors 4 and 26 to 29 are to be stopped, the CPU 48 outputs a rotation speed of zero to the DR 41, and accordingly, each DR 41 does not output a pulse signal, thereby stopping the conveyance motors 4 and 26 to 29.

The air intake fans 24 and the air exhaust fans 25 can be similarly controlled. The motor controller 45 outputs PWM signals corresponding to the target rotation speeds of the air intake fans 24 and the air exhaust fans 25 to a DR 42.

In addition, a stepping motor can be also used for controlling the path switching gate 6. In such a case, when the traveling sensor 3 detects a leading edge of a sheet, the motor controller 46 is received an instruction on the amount of rotation and the direction of rotation from the CPU 48. The motor controller 46 outputs an instruction of the rotation direction and pulse signals of a predetermined frequency, which correspond to the amount of rotation, to a DR 43. The DR 43 drives the path switching gate 6 by a rotation angle corresponding to the number of the received pulse signals in the instructed rotation direction, and accordingly, the path switching gate 6 can be switched to a desired position. Here, a mechanism used for controlling the path switching gate 6 can be appropriately designed.

Determination of Conveying Path

The cooling conveyance device is received, from the image forming apparatus 100, an instruction on a cooling conveyance method for conveying a sheet 20 based on the type of the sheet, the thickness of the sheet, the fixing temperature, the interior temperature and humidity, and the length of a conveying path from the image forming apparatus 100 to the loading unit.

The cooling conveyance device 98 switches among a plurality of the branched cooling paths 7 to 9 or temporarily stops sheets in a plurality of the branched cooling paths 7 to 9 in accordance with an instruction of the image forming apparatus 100.

Figure 7:
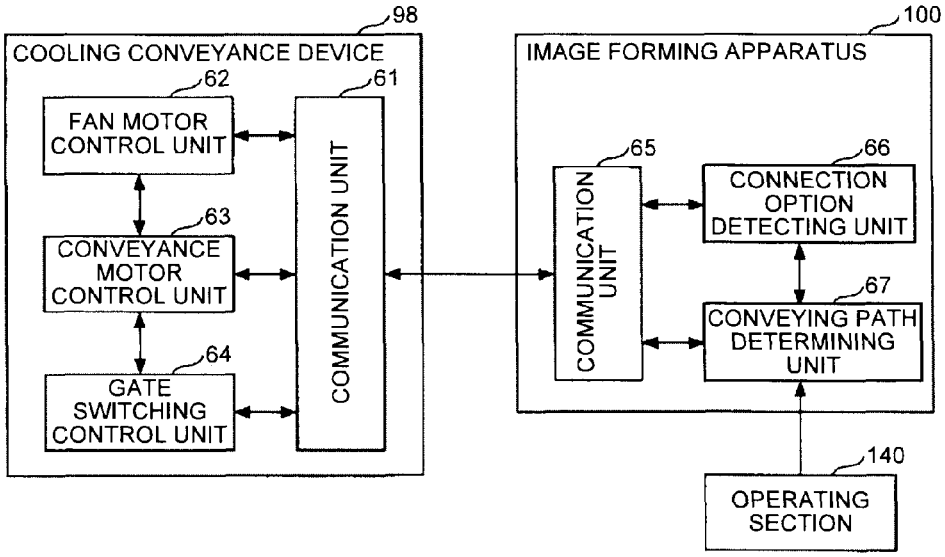
FIG. 7 is an example of a functional block diagram illustrating an image forming apparatus and a cooling conveyance device.

FIG. 7 is an example of a functional block diagram illustrating the image forming apparatus 100 and the cooling conveyance device 98. The image forming apparatus 100 includes a communication unit 65, a connected option detecting unit 66, and a conveying path determining unit 67. The connected option detecting unit 66 detects the above-described options connected to the image forming apparatus 100. Since the image forming apparatus 100 and the options are electrically connected to each other in a tree structure with the image forming apparatus 100 as vertex or in a continuous form, the type of option that is connected to the image forming apparatus 100 is known by the image forming apparatus 100.

In addition, in a case where a binding device, a Z folding unit, and the like are connected as the options, a sheet 20 that passes through the cooling conveyance device 98 is not immediately stacked, and accordingly, it may be assumed that there is no possibility that the toner blocking phenomenon occurs.

The connected option detecting unit 66 detects options as described above and notifies the conveying path determining unit 67 that the switching to one of the branched cooling paths 7 to 9 is not necessary. For example, a relation between the option and the length of the conveying path or the conveyance time is registered in advance, and if an accumulated value of the length of the conveying paths or the conveyance time of detected options is a predetermined value or more, it is detected that the switching to one of the branched cooling paths 7 to 9 is not necessary. Alternatively, it may be detected that the switching is not necessary by detecting that the number of options detected on the downstream of the cooling conveyance device 98 is a predetermined value or more. Furthermore, an option for which the switching to one of the branched cooling paths 7 to 9 is not necessary, in other words, an option of which the length of the conveying path or the conveyance time is a predetermined value or more is registered in the image forming apparatus 100 before stacking a sheet, and the connected option detecting unit 66 detects the connection of the registered option, whereby it may be determined that the switching to one of the branched cooling paths 7 to 9 is not necessary.

Next, the conveying path determining unit 67 determines a conveying path in accordance with the type of the sheet, the thickness of the sheet, the set fixing temperature, and the interior temperature and humidity.

Figure 8:
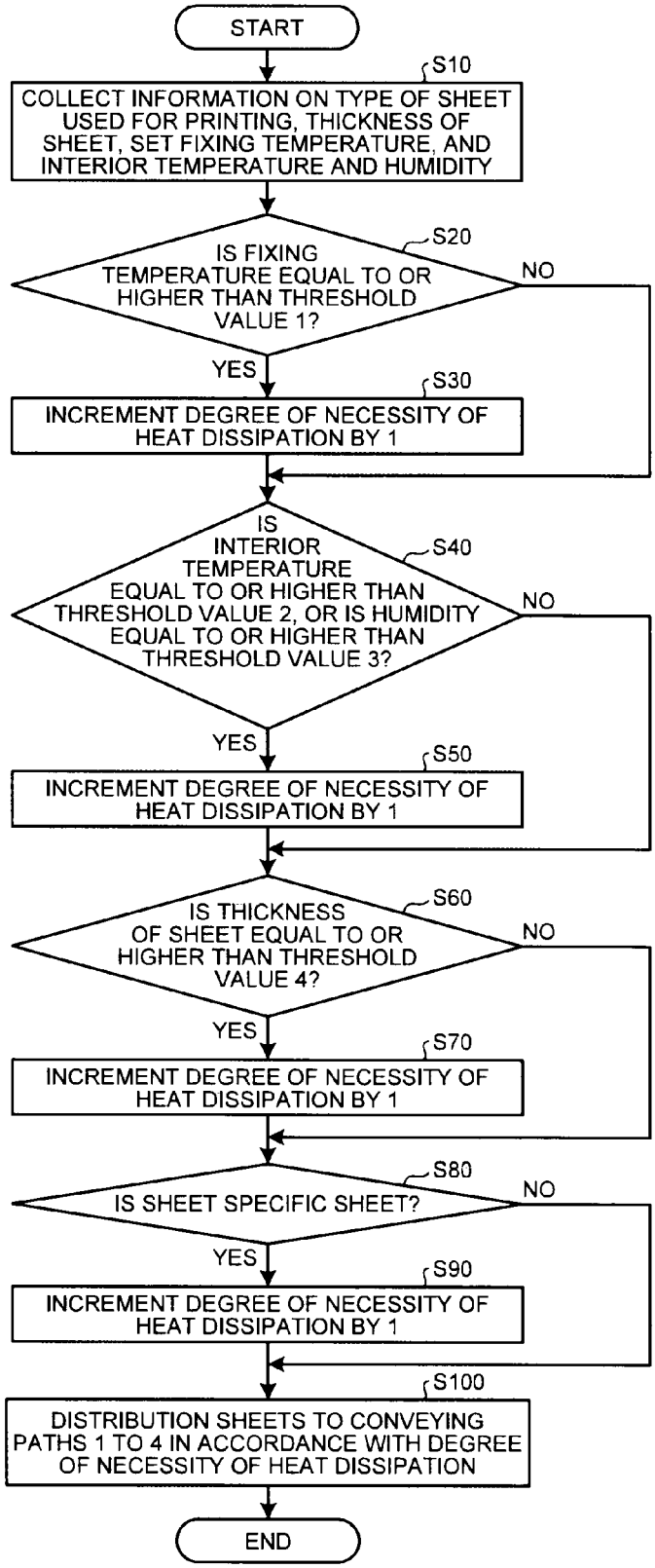
FIG. 8 is an example of a flowchart diagram illustrating the sequence that a conveying path determining unit determines a conveying path.

FIG. 8 is an example of a flowchart illustrating the sequence of determining a conveying path that is performed by the conveying path determining unit 67.

The conveying path determining unit 67, first, collects information on the type of sheet used for printing, the thickness of the sheet, the set fixing temperature, and the interior temperature and humidity in Step S10. The type of sheet and the thickness of the sheet are input by a user selecting the type and the thickness of the sheet from the operating section 140. The set fixing temperature is set as a parameter in the engine I/F 156 of the image forming apparatus 100. The interior temperature or humidity may be acquired from a sensor that is built in the image forming apparatus 100 or may be input from the operating section 140 by a user.

Then, the conveying path determining unit 67 compares, for each piece of the corrected information, the collected value with a corresponding threshold value, and when the collected value satisfies the condition, the conveying path determining unit 67 counts up the degree of necessity of heat dissipating. The degree of necessity of heat dissipating is a parameter used for determining a conveying path by the conveying path determining unit 67, and has a larger value as the temperature of the sheet easily rises.

First, the conveying path determining unit 67 determines whether or not the fixing temperature is equal to or higher than threshold value 1 (for example, 200 to 220 degrees) in Step S20. In a case where the fixing temperature is equal to or higher than the threshold value 1 (Yes in Step S20), the conveying path determining unit 67 increments the degree of necessity of heat dissipating by one in Step S30. In contrast, in a case where the fixing temperature is less than the threshold value 1 (No in Step S20), the process of Step S30 is not performed.

The conveying path determining unit 67 determines whether or not the interior temperature is equal to or higher than threshold 2 (for example, 40 to 50 degrees), or the humidity is equal to or higher than threshold value 3 (for example, 50 to 60%) in Step S40. In a case where the interior temperature is equal to or higher than the threshold value 2, or the humidity is equal to or higher than the threshold value 3 (Yes in Step S40), the conveying path determining unit 67 increments the degree of necessity of heat dissipating by one in Step S50. In contrast, in a case where the interior temperature is less than the threshold value 2, and the humidity is less than the threshold value 3 (No in Step S40), the process of Step S50 is not performed.

The conveying path determining unit 67 determines whether or not the thickness of the sheet is equal to or more than threshold value 4 (for example, 80 g/m$^2$) in Step S60. In a case where the thickness of the sheet is equal to or more than the threshold value 4 (Yes in Step S60), the conveying path determining unit 67 increments the degree of necessity of heat dissipating by one in Step S70. In contrast, in a case where the thickness is less than the threshold value 4 (No in Step S60), the process of Step S70 is not performed.

The conveying path determining unit 67 determines whether or not the type of the sheet is a specific type in Step S80. In a case where the type of the sheet is the specific type that is registered in advance (Yes in Step S80), the conveying path determining unit 67 increments the degree of necessity of heat dissipating by one in Step S90. In contrast, in a case where the type of the sheet is not the specific type that is registered in advance (No in Step S80), the process of Step S90 is not performed. Here, the specific type of the sheet is registered in the image forming apparatus 100 in advance.

Then, the conveying path determining unit 67 determines the conveying path to be one of the conveying paths 1 to 4 to be described later in accordance with the degree of necessity of heat dissipating in Step S100. It is assumed that the conveying paths 1 to 4 have higher cooling capacities of a sheet as the reference numeral thereof is greater (in addition, the cooling capacities of the conveying paths 3 and 4 may be interchanged in accordance with the places of the air intake fans). Accordingly, for example, in a case where the degrees of necessity of heat dissipating are 1, 2, 3, and 4, the conveying path determining unit 67 determines the conveying path to be the conveying paths 1, 2, 3, and 4, respectively. In such a case, the stop time may be set to a fixed value (for example, 4*t* to be described later).

Here, the method of calculating the degree of necessity of heat dissipating is merely an example, and the weighting factor of the degree of necessity of heat dissipating may be changed in accordance with the type of sheet, the thickness of the sheet, the set fixing temperature, and the interior temperature and humidity. Accordingly, the degree of necessity of heat dissipating may be determined so as to appropriately reflect the degree of easiness in the rise of the sheet temperature. In such a case, the stop time may be increased in accordance with the degree of necessity of heat dissipating as follows.

degrees of necessity of heat dissipating 1 to 4: conveying paths 1 to 4 (stop time: zero)

degrees of necessity of heat dissipating 5 to 7: conveying paths 2 to 4 (stop time: 4*t*)

degrees of necessity of heat dissipating 8 to 10: conveying paths 2 to 4 (stop time: 6*t*)

The conveying paths 1 to 4 are conveying paths described as follows, but the details thereof will be described in detail later.

Conveying path 1: Sheets are sequentially distributed to the branched cooling paths 7 to 9.

Conveying path 2: Sheets are sequentially distributed to the branched cooling paths 7 to 9, and are stopped at the same position.

Conveying path 3: Sheets are sequentially distributed to the branched cooling paths 7 to 9, and the positions at which the sheets are stopped are changed for the sheets.

Conveying path 4: Sheets are sequentially distributed to the branched cooling paths 7 to 9, and stop positions are determined such that the stop positions of the sheets in adjacent branched cooling paths are not the same.

The conveying path determining unit 67 gives an instruction for cooling conveyance, for example, as follows to the cooling conveyance device 98 in accordance with the determined conveying path.

(i) {distribution to branched cooling path: (Yes or No)}
(ii) {stop time: (zero or stop time t)}
(iii) {stop position: (1, 2, 3, or 4)}

Accordingly, the instruction for each conveying path 1 to 4 is as follows.

conveying path 1: {distribution to branched cooling paths: (Yes)}, {stop time: (zero)}, {stop position: (–)} conveying path 2: {distribution to branched cooling paths: (Yes)}, {stop time: (nt)}, {stop position: (1 or 2)} conveying path 3: {distribution to branched cooling paths: (Yes)}, {stop time: (nt)}, {stop position: (3)} conveying path 4: {distribution to branched cooling paths: (Yes)}, {stop time: (nt)}, {stop position: (4)}

Here, the stop position (1) is an instruction for setting the stop positions to stop positions 30, 32, and 34 illustrated in FIGS. 4A to 4F, and the stop position (2) is an instruction for setting the stop positions to stop positions 31, 33, and 35 illustrated in FIGS. 4A to 4F. In addition, "n" is a natural number.

In addition, the stop position (3) is an instruction for switching the stop position between the stop position (1) and the stop position (2) for each sheet on the branched cooling paths 7 to 9.

The stop position (4) is an instruction for setting the stop positions of sheets in the adjacent branched cooling paths out of the branched cooling paths 7 to 9 to be different from each other.

In addition, the conveying path determining unit 67 may simply determine that the sheets are to be distributed to the branched cooling paths 7 to 9 (the instruction is "the conveying path 1") only in a case where at least one condition of the following four conditions are satisfied: (i) the type of sheet is a specific type of sheet; (ii) the thickness of the sheet is equal to or more than the threshold value 4; (iii) the fixing temperature is equal to or higher than the threshold value 1; (iv) the interior temperature is equal to or higher than the threshold value 2; and (v) the interior humidity is equal to or higher than the threshold value.

Furthermore, in such a case, in order to perform not only distributing the sheets but also stopping the sheets, the conveying path determining unit 67 may designate one of the conveying paths 2, 3, and 4 as a fixed conveying path.

Referring back to FIG. 7, the cooling conveyance device 98 includes a communication unit 61, a fan motor control unit 62, a conveyance motor control unit 63, and a gate switching control unit 64. The fan motor control unit 62 rotates the air intake fans 24 and the air exhaust fans 25 at a constant rotation speed or at a rotation speed according to the temperature of the inside of the cooling conveyance device 98.

The conveyance motor control unit 63 controls stop/rotation of respective conveyance motors 4, 26, 27, and 28 based on the position of the sheet detected by the traveling sensors 3 and 14 to 16 in accordance with an instruction for cooling conveyance that is transmitted from the image forming apparatus 100. In addition, the rotation speeds of the conveyance motors 26, 27, and 28 are set in advance such that the passing time of each sheet is the same.

In addition, in a case where the stop time of the instruction for cooling conveyance is other than zero, the conveyance motor control unit 63 maintains the conveyance motors 4, 26, 27, and 28 to be in a stopped state at the stop position (1) or (2) during the stop time t.

The gate switching control unit 64 causes the path switching gate 6 to switch the connection destination of the conveying path 5 to one of the branched cooling paths 7 to 9. In a case where the "distribution to the branched cooling paths 7 to 9" is "No" in the instruction transmitted from the image forming apparatus 100, the conveying path determining unit 67 fixes the branched cooling path without changing the branched cooling path (uses one of the branched cooling paths 7 to 9).

In a case where the "distribution to the branched cooling paths" is "Yes" in the instruction for cooling conveyance that is transmitted from the image forming apparatus 100, the conveying path determining unit 67 sequentially switches the connection destination of the conveying path 5 per sheet to the branched cooling paths 7 to 9.

Cooling Conveyance Operation in Case Where Branched Cooling Path is Not Changed

For a comparison with the effect of the branched cooling path according to this embodiment, a cooling conveyance operation in a case where the branched cooling path is not changed will be described with reference to FIG. 9.

Figure 9:
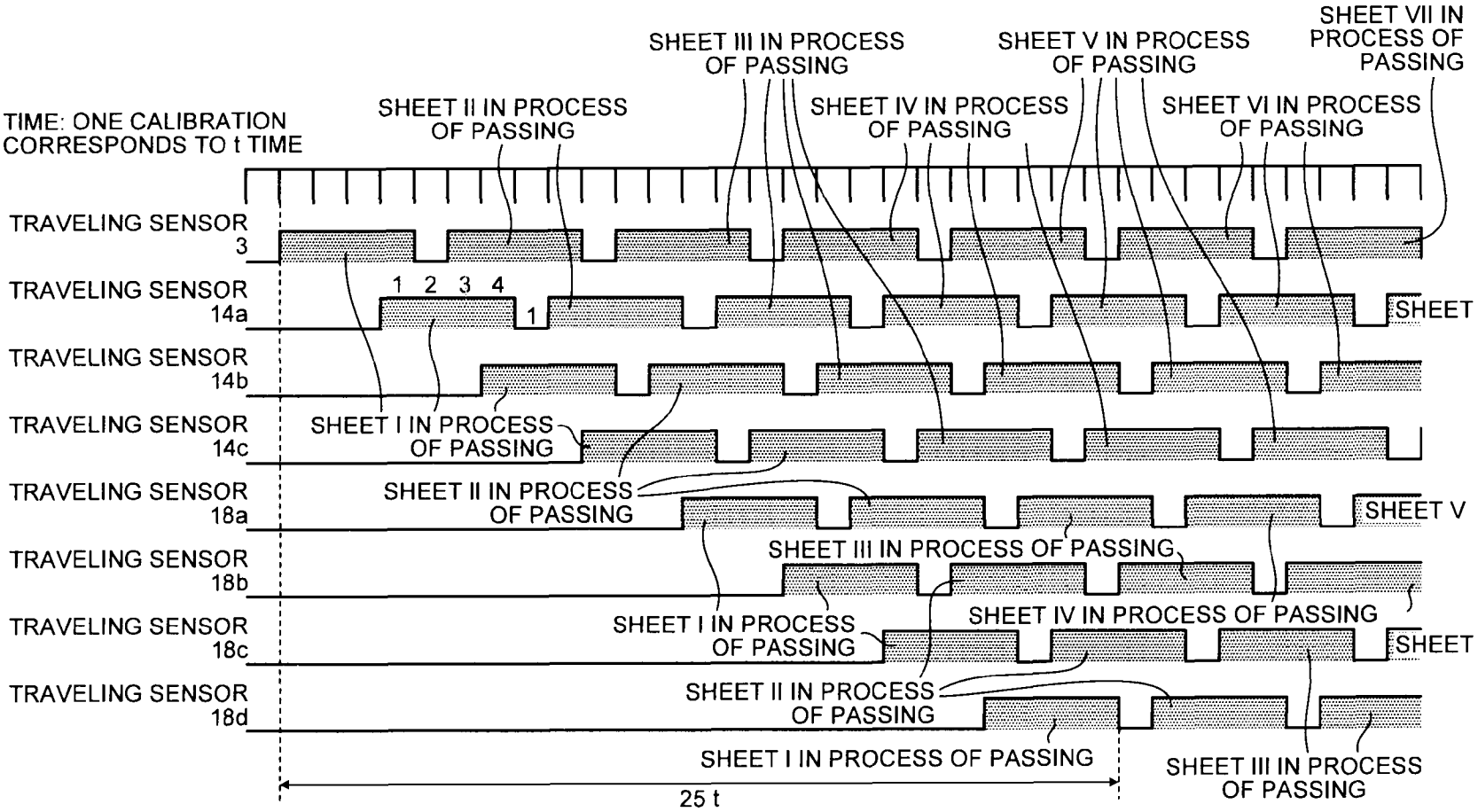
FIG. 9 is an example of a timing chart diagram illustrating a cooling conveyance operation in a case where no switching between branched conveying paths is performed, for a comparison with the effect of the branched cooling path.

FIG. 9 illustrates a timing chart illustrating a sheet detecting time and a sheet non-detecting time. A time (hereinafter, referred to as a sheet detecting time) during which a sheet is detected by each traveling sensor is represented by applying shading thereto, and a time (hereinafter, referred to as a sheet non-detecting time) during which a sheet is not detected by each traveling sensor is represented by not applying shading thereto. The sheet detecting time is a time during which sheets are cooled by the branched cooling paths 7 to 9 and the cooling path 11, and heat is accumulated in the branched cooling paths 7 to 9 and the cooling path 11. The sheet non-detecting time is a time during which the heat accumulated in the branched cooling paths 7 to 9 and the cooling path 11 is dissipated.

Note that, although a state is illustrated in FIG. 9 in which the conveying path is fixed to the branched cooling path 7, the timing chart is the same even in a case where the conveying path is fixed to one of the branched cooling paths 8 and 9. In a case where the branched cooling paths 8 and 9 are not used, in order to suppress noises and power consumption, the cooling conveyance device 98 stops the conveyance motors 27 and 28 of the branched cooling paths 8 and 9 to which any sheet is not conveyed in order to suppress noise and power consumption.

In a case where conveyance is performed without switching to a plurality of the branched cooling paths 7 to 9 that are branched, after passing through the traveling sensor 3, a sheet 20 conveyed to the cooling conveyance device 98 sequentially passes through the traveling sensor 14*a*, the traveling sensor 14*b*, the traveling sensor 14*c*, a traveling sensor 18*a*, a traveling sensor 18*b*, a traveling sensor 18*c*, and a traveling sensor 18*d*. In addition, the sheet passing time of a sheet I is a time 25*t*. This sheet passing time is the same as a sheet cooling time during which the sheet is cooled by the cooling conveyance device 98.

FIG. 10 is an example of a diagram illustrating the ratio between a sheet detecting time and a sheet non-detecting time in numeric values. In a case where sheets are sequentially conveyed without any interruption, as illustrated in FIG. 10, in both traveling sensors 14 and 18 arranged on the branched cooling path 7 and the cooling path 11, the ratio between the sheet detecting time and the sheet non-detecting time is 4:1 (80%:20%). In FIG. 10, one calibration illustrated in the timing chart is set to a "time t". This "time t" is also the passing interval of a sheet.

Accordingly, in a case where it is difficult for the branched cooling path 7 and the cooling path 11 to dissipate heat, which is accumulated in the cooling paths for a time 4*t*, for the time t, the next sheet needs to be sequentially cooled in a state in which it is difficult to dissipate the heat of the branched cooling path 7 and the cooling path 11, whereby the cooling effect decreases.

In a case where a condition (the type of sheet, the thickness of the sheet, the set fixing temperature, and the interior temperature and humidity) in which heat can be easily accumulated is formed, and sheets are sequentially conveyed without any interruption, the heat of the branched cooling path 7 and the cooling path 11 is not sufficiently dissipated, and the cooling effect of decreasing the temperature of sheets deteriorates.

When the temperature of sheets can be sufficiently lowered in a condition other than the above-described condition in which heat can be easily accumulated, the cooling conveyance device 98 performs cooling conveyance illustrated in FIG. 10 in accordance with an instruction for cooling conveyance that is transmitted from the image forming apparatus 100.

Cooling Conveyance Operation In Case Where Switching to Branched Cooling Path is Performed (Conveying Path 1)

Figure 11:
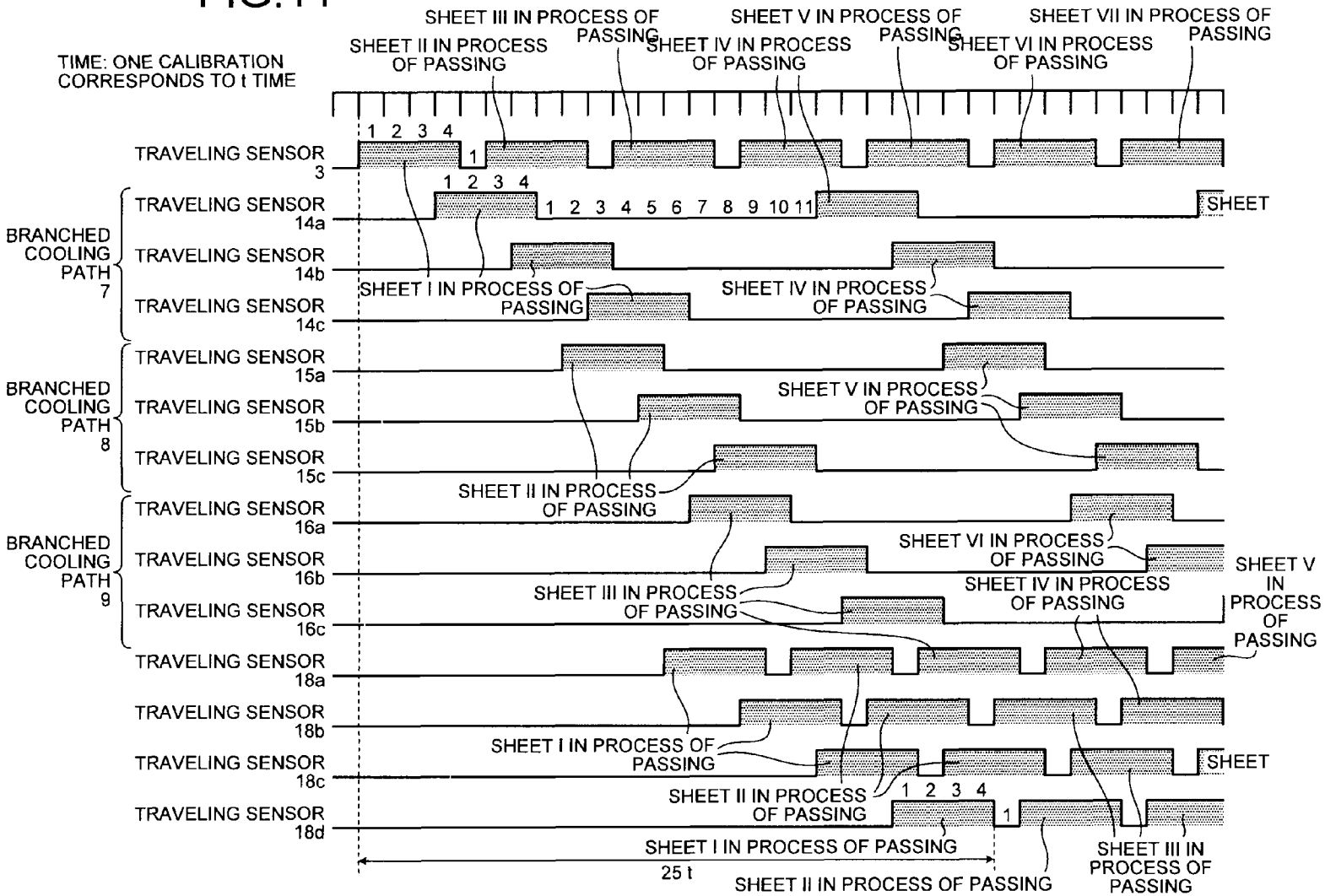
FIG. 11 is an example of a timing chart diagram of a sheet detecting time and a sheet non-detecting time in a case where the cooling path is changed.

FIG. 11 illustrates a timing chart of a sheet detecting time and a sheet non-detecting time in a case where the cooling path is changed. In other words, a cooling conveyance operation and the cooling effect thereof in a case where the cooling conveyance device 98 sequentially distributes sheets, one by one, to the three branched cooling paths 7 to 9.

In FIG. 11, a sheet detecting time in each traveling sensor is represented by applying shading thereto, and a sheet non-detecting time in each traveling sensor 14, 15, 16, or 18 is represented by not applying shading thereto. The sheet detecting time is a time during which sheets are cooled by the branched cooling paths 7 to 9 and the cooling path 11, and heat is accumulated in the branched cooling paths 7 to 9 and the cooling path 11. In addition, the sheet non-detecting time is a time during which the heat accumulated in the branched cooling paths 7 to 9 and the cooling path 11 is dissipated.

Since the sheet passing time is constant regardless of switching to the branched cooling paths 7 to 9, the sheet passing time of the case illustrated in FIG. 11 is a time 25*t* that is the same as that of a case illustrated in FIG. 9. The sheet passing time is a time during which a sheet is cooled by the cooling conveyance device 98.

The cooling conveyance device 98 sequentially distributes sheets, one by one, to the three branched cooling paths 7 to 9.

As is illustrated in the traveling sensor 3 in a time series, sheets I to VII are sequentially conveyed to the cooling conveyance device 98 from the image forming apparatus 100. Here, sheets I and IV are distributed to the branched cooling path 7, sheets II and V are distributed to the branched cooling path 8, and sheets III and VI are distributed to the branched cooling path 9.

The sheets I and IV that have passed through the traveling sensor 3 sequentially pass through the traveling sensor 14*a*, the traveling sensor 14*b*, the traveling sensor 14*c*, the traveling sensor 18*a*, the traveling sensor 18*b*, the traveling sensor 18*c*, and the traveling sensor 18*d*.

The sheets II and V that have passed the traveling sensor 3 sequentially pass through the traveling sensor 15*a*, the traveling sensor 15*b*, the traveling sensor 15*c*, the traveling sensor 18*a*, the traveling sensor 18*b*, the traveling sensor 18*c*, and the traveling sensor 18*d*.

The sheets III and VI that have passed the traveling sensor 3 sequentially pass through the traveling sensor 16*a*, the traveling sensor 16*b*, the traveling sensor 16*c*, the traveling sensor 18*a*, the traveling sensor 18*b*, the traveling sensor 18*c*, and the traveling sensor 18*d*.

FIG. 12 is a diagram that illustrates the relation between the ratio of a sheet detecting time and the ratio of a sheet non-detecting time for each traveling sensor in a case where the timing chart illustrated in FIG. 11 is employed. In a case where sheets are sequentially conveyed without any interruption, as illustrated in FIG. 12, the ratio between the sheet detecting time and the sheet non-detecting time of the traveling sensor 3 arranged in the conveying path 5 and the traveling sensor 18*a*, the traveling sensor 18*b*, the traveling sensor 18*c*, and the traveling sensor 18*d* arranged in the cooling path 11 is 4:1 (80%:20%), which is the same as that illustrated in FIG. 10. Accordingly, in the conveying path 5 and the cooling path 11, heat accumulated in the cooling path for a time 4*t* is dissipated for a time t.

In contrast to this, the ratio between the sheet detecting time and the sheet non-detecting time of the traveling sensor 14*a*, the traveling sensor 14*b*, and the traveling sensor 14*c* arranged in the branched cooling path 7, the traveling sensor 15*a*, the traveling sensor 15*b*, and the traveling sensor 15*c* arranged in the branched cooling path 8, and the traveling sensor 16*a*, the traveling sensor 16*b*, and the traveling sensor 16*c* arranged in the branched cooling path 9 is 4:11 (26.7%:73.3%). In addition, even when a sheet passes through any one of the branched cooling path 7, the branched cooling path 8, and the branched cooling path 9, the sheet passing time remains as 25*t*.

When compared with the case illustrated in FIG. 9, the sheet non-detecting time increases from 20% to 73.3%, and accordingly, the heat dissipating effect of the cooling path 11 increases from the state illustrated in FIG. 9 by 53.3%. Accordingly, compared to the case where sheets are not distributed as illustrated in FIG. 9, the cooling effect of sheets from the conveying path 5 to the cooling path 11 can maintained well.

The ratio between the sheet detecting time and the sheet non-detecting time of the traveling sensors 18*a*, 18*b*, 18*c*, and 18*d* is 4:1 (80%:20%). The sheet non-detecting time is a time t, which is the same as that of the traveling sensor 3. Accordingly, it can be checked that the productivity is the same as that of a case where branching is not performed and does not decrease at all.

Therefore, according to the features of this embodiment illustrated in FIGS. 11 and 12, in the state in which heat can be easily accumulated, even when the sheets are sequentially conveyed without any interruption, the sheets can be expected to be sufficiently cooled.

When sheets are sequentially conveyed without any interruption, the image forming apparatus 100 instructs the cooling conveyance device 98 to perform cooling conveyance illustrated in FIG. 11 in accordance with a combination of a plurality of conditions (a combination of the type of sheet, the thickness of the sheet, the set fixing temperature, the interior temperature and humidity, and the length of a conveying path from the image forming apparatus 100 to the loading unit) or one or more conditions described above.

Cooling Conveyance Operation in Case Where Switching to Branched Cooling Path is Performed (Conveying Path 2)

Figure 13:
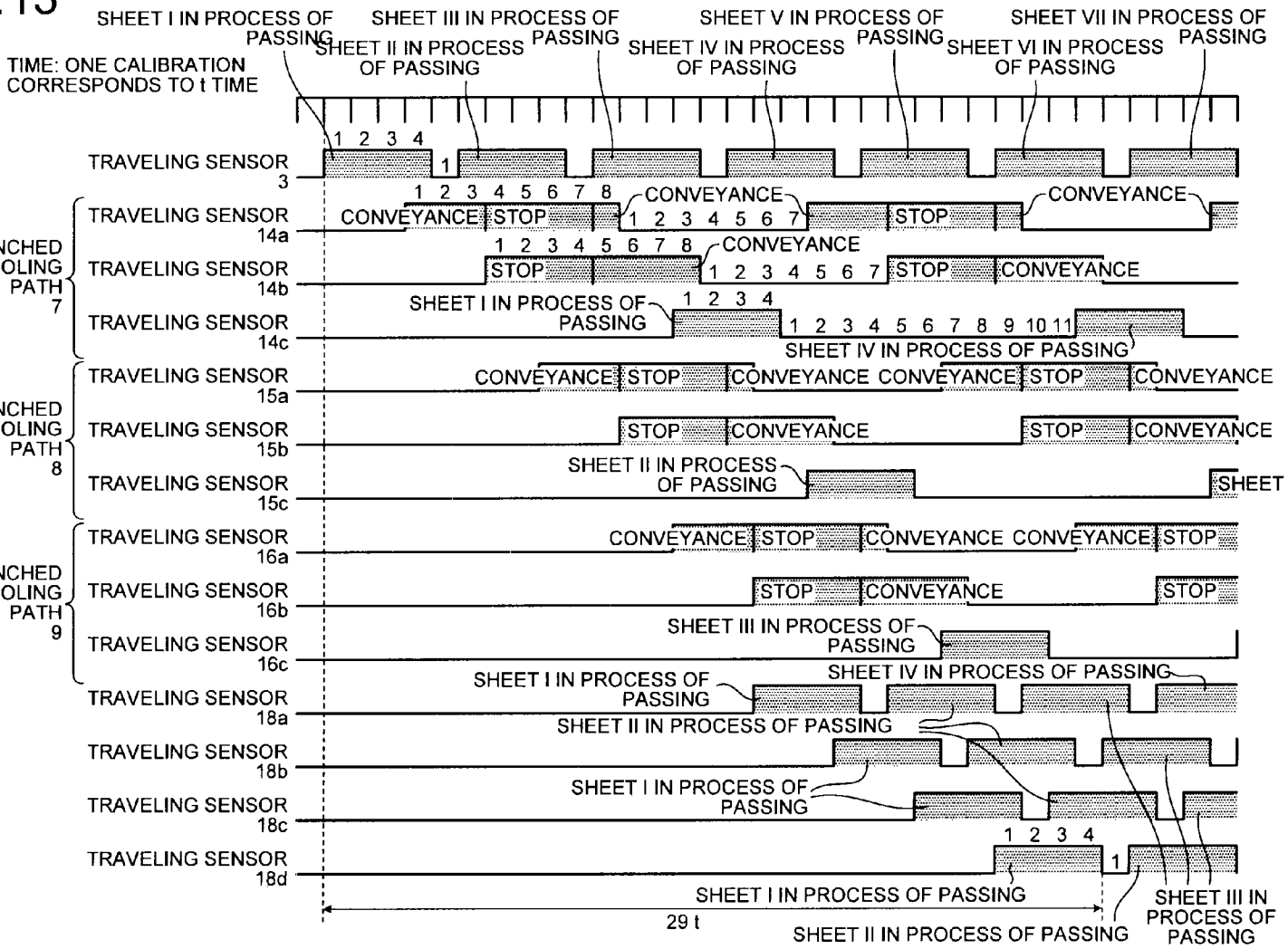
FIG. 13 is an example of a timing chart diagram illustrating a sheet detecting time and a sheet non-detecting time in a case where the cooling path is changed, and a sheet is stopped within a branched cooling path.

FIG. 13 illustrates a timing chart of a sheet detecting time and a sheet non-detecting time in a case where the cooling path is changed, and a sheet is stopped within a branched cooling path.

In FIG. 13, a sheet detecting time in each traveling sensor is represented by applying shading thereto, and a sheet non-detecting time in each traveling sensor is represented by not applying shading thereto. Since the sheet detecting time and the sheet non-detecting time have been described above, the description thereof will not be repeated here.

The cooling conveyance device 98 sequentially distributes sheets, one by one, to the three branched cooling paths 7 to 9.

All the sheets I to VII conveyed to the cooling conveyance device 98 pass through the traveling sensor 3. Here, sheets I and IV sequentially pass through the traveling sensor 14*a*, the traveling sensor 14*b*, the traveling sensor 14*c*, the traveling sensor 18*a*, the traveling sensor 18*b*, the traveling sensor 18*c*, and the traveling sensor 18*d*.

After the sheet I is stopped for a time 4*t* in the state of being detected by the traveling sensor 14*a* and the traveling sensor 14*b*, the conveyance thereof is continued. The sheet I is conveyed for a time 3*t* in the state of being detected by the traveling sensor 14*a* so as to arrive at the traveling sensor 14*b*. In this state, the sheet I is stopped for a time 4*t*.

Thereafter, the sheet I is conveyed for a time 1*t* in the state of being detected by the traveling sensor 14*a*, whereby being conveyed for a total time of 4*t*. In addition, the sheet I is conveyed for a time 4*t* in the state of being detected by the traveling sensor 14*b* and is sent out to the cooling path 11 without being stopped at the traveling sensor 14*c*. A similar process is performed for the sheet IV.

The sheets II and V that have passed through the traveling sensor 3 sequentially pass through the traveling sensor 15*a*, the traveling sensor 15*b*, the traveling sensor 15*c*, the traveling sensor 18*a*, the traveling sensor 18*b*, the traveling sensor 18*c*, and the traveling sensor 18*d*.

After the sheet II is stopped for a time 4*t* in the state of being detected by the traveling sensor 15*a* and the traveling sensor 15*b*, the sheet II continues to be conveyed. The sheet II is conveyed for a time 3*t* in the state of being detected by the traveling sensor 15*a*, and thereby arriving at the traveling sensor 15*b*. In this state, the sheet II is stopped for a time 4*t*.

Thereafter, the sheet II is conveyed for a time 1*t* in the state of being detecting by the traveling sensor 15*a* so as to be conveyed for a total time of 4*t*. In addition, the sheet II is conveyed for a time 4*t* in the state of being detected by the traveling sensor 15*b* and is sent out to the cooling path 11 without being stopped at the traveling sensor 15*c*. A similar process is performed for the sheet V.

The sheets III and VI that have passed through the traveling sensor 3 sequentially pass through the traveling sensor 16*a*, the traveling sensor 16*b*, the traveling sensor 16*c*, the traveling sensor 18*a*, the traveling sensor 18*b*, the traveling sensor 18*c*, and the traveling sensor 18*d*.

After the sheet III is stopped for a time 4*t* in the state of being detected by the traveling sensor 16*a* and the traveling sensor 16*b*, the sheet III continues to be conveyed. The sheet III is conveyed for a time 3*t* in the state of being detected by the traveling sensor 16*a*, and thereby arriving at the traveling sensor 16*b*. In this state, the sheet III is stopped for a time 4*t*.

Thereafter, the sheet III is conveyed for a time 1*t* in the state of being detecting by the traveling sensor 16*a* so as to be conveyed for a total time of 4*t*. In addition, the sheet III is conveyed for a time 4*t* in the state of being detected by the traveling sensor 16*b* and is sent out to the cooling path 11 without being stopped at the traveling sensor 16*c*. A similar process is performed for the sheet VI.

FIG. 14 is a diagram that illustrates a relation between the ratio of a sheet detecting time and the ratio of a sheet non-detecting time for each traveling sensor in a case where the timing chart illustrated in FIG. 13 is employed. In a case where sheets are sequentially conveyed without any interruption, as illustrated in FIG. 14, the ratio between the sheet detecting time and the sheet non-detecting time of the traveling sensor 3 arranged in the conveying path 5 and the traveling sensor 18*a*, the traveling sensor 18*b*, the traveling sensor 18*c*, and the traveling sensor 18*d* is 4:1 (80%:20%), which is the same as that of a case where the branched cooling paths 7 to 9 are not used. Accordingly, heat accumulated in the cooling path 11 for a time 4*t* is dissipated for a time t. As a result, the sheet passing time is 29*t*.

In contrast to this, the ratio between the sheet detecting time and the sheet non-detecting time of the traveling sensor 14*a*, the traveling sensor 14*b*, the traveling sensor 15*a*, the traveling sensor 15*b*, the traveling sensor 16*a*, the traveling sensor 16*b* is 8:7 (53.3%:46.7%).

In this case, the heat dissipating effect increases by 18.9% from a case where the cooling path is not changed. Accordingly, by maintaining the sheet as illustrated in FIG. 14, the cooling effect can be maintained well, compared to a case where the cooling path is not changed.

In addition, as is apparent by comparing the sheet passing time, by stopping the sheet, the time for which heat is accumulated in the cooling path is increased by a time 4*t* from a case where the cooling path is not changed. Accordingly, it can be understood that the cooling effect of sheets is also high.

The ratio between a sheet detecting time and a sheet non-detecting time of the traveling sensor 14*c*, the traveling sensor 15*c*, and the traveling sensor 16*c* that are disposed on the downstream side of each cooling path is 4:11 (26.7%:73.3%). Accordingly, the heat dissipating effect increases by 53.3% from a case where the cooling path is not changed. Accordingly, by maintaining the sheet as illustrated in FIG. 13, the cooling effect can be maintained relatively well, compared to a case where the cooling path is not changed.

In addition, the ratio between the sheet detecting time and the sheet non-detecting time of the traveling sensor 18*d* is 4:1 (80%:20%), and the sheet non-detecting time is a time t. This is the same as that of a case where the cooling path is not changed, and the productivity is not lowered. In other words, since the sheet passing time of the cooling conveyance device 98 of the case illustrated in FIG. 14 is a time 29*t*, the sheet passing time increases by a time 4*t* as compared with a case where the cooling path is not changed. However, this means that a time required for outputting the first one page only increases by the time 4*t*, and printing is performed every time t thereafter.

Cooling Conveyance Operation in Case Where Switching to Branched Cooling Path is Performed (Conveying Path 3)

Figure 15:
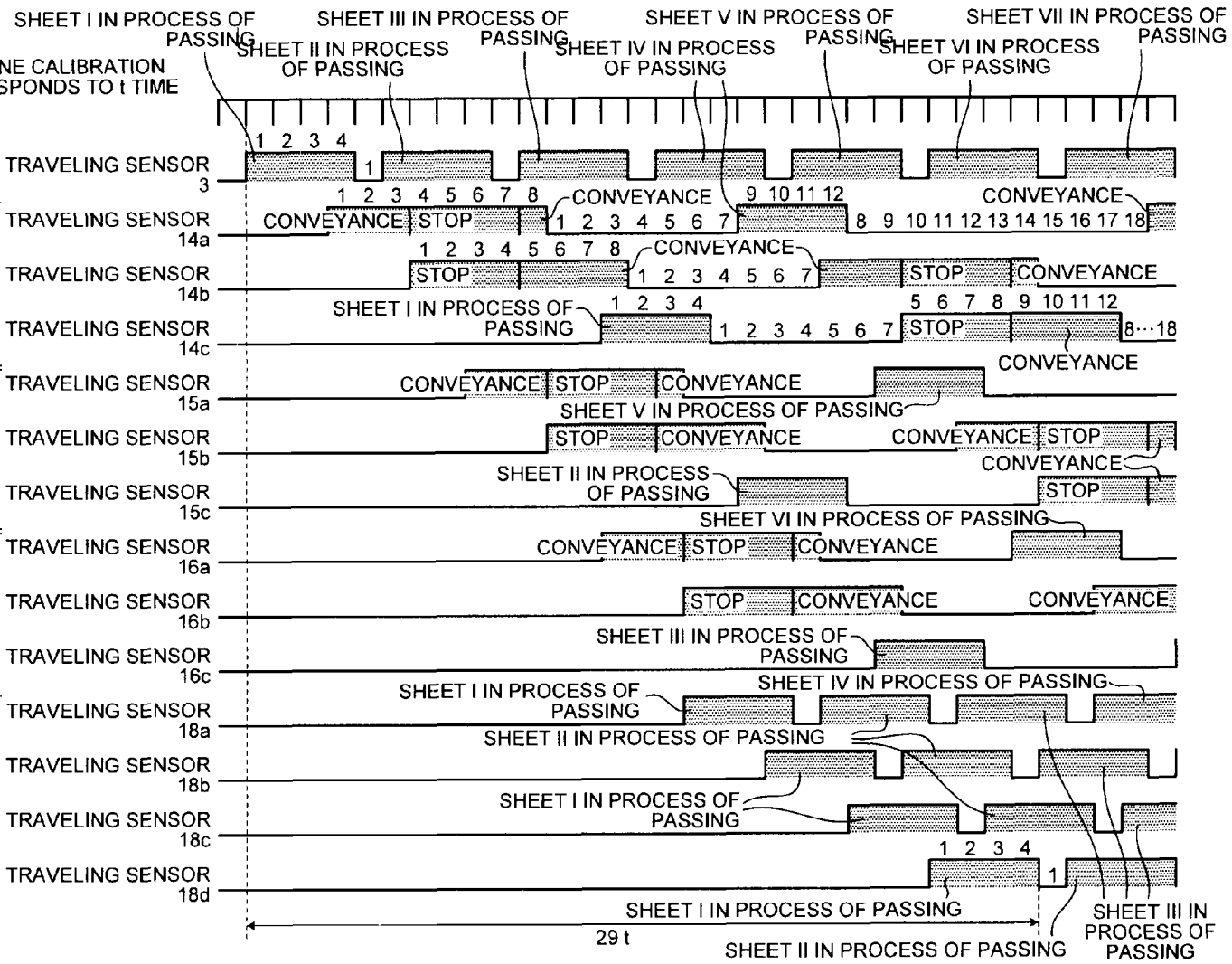
FIG. 15 is an example of a timing chart diagram of a sheet detecting time and a sheet non-detecting time in a case where a sheet is stopped alternately at two positions in the cooling path for a time 4*t* for each stop.

FIG. 15 illustrates a timing chart of a sheet detecting time and a sheet non-detecting time in a case where a sheet is alternately stopped for a time 4*t* at two positions in the cooling path. In other words, when described in terms of the branched cooling path 7, after a sheet is stopped between the traveling sensors 14*a* and 14*b*, the cooling conveyance device 98 sends out the sheet to the branched cooling paths 8 and 9, and then stops the sheet between the traveling sensor 14*b* and the traveling sensor 14*c* in the branched cooling path 7.

Similarly to the conveying paths 1 and 2, the cooling conveyance device 98 sequentially conveys sheets by switching, for each sheet, the conveyance destination of a sheet to one of the three branched cooling paths 7 to 9. Then, sheets I and IV that are conveyed from the image forming apparatus 100 to the cooling conveyance device 98 and passes through the traveling sensor 3 sequentially pass through the traveling sensor 14*a*, the traveling sensor 14*b*, the traveling sensor 14*c*, the traveling sensor 18*a*, the traveling sensor 18*b*, the traveling sensor 18*c*, and the traveling sensor 18*d*.

After the sheet I is stopped for a time 4*t* in the state of being detected by the traveling sensor 14*a* and the traveling sensor 14*b*, the sheet I passes through the traveling sensor 14*c* and is conveyed through the conveying path 18. The sheet IV passes through the traveling sensor 14*a* without being stopped and is stopped for a time 4*t* in the state of being detected by the traveling sensor 14*b* and the traveling sensor 14*c*, and then is continuously conveyed through the conveying path 18.

The sheets II and V that are conveyed from the image forming apparatus 100 to the cooling conveyance device 98 and pass through the traveling sensor 3 sequentially pass through the traveling sensor 15*a*, the traveling sensor 15*b*, the traveling sensor 15*c*, the traveling sensor 18*a*, the traveling sensor 18*b*, the traveling sensor 18*c*, and the traveling sensor 18*d*.

After the sheet II is stopped for a time 4*t* in the state of being detected by the traveling sensor 15*a* and the traveling sensor 15*b*, the sheet II passes through the traveling sensor 15*c* and continues to be conveyed through the conveying path 18. The sheet V passes through the traveling sensor 15*a* without being stopped is stopped for a time 4*t* in the state of being detected by the traveling sensor 15*b* and the traveling sensor 15*c*, and then is continuously conveyed through the conveying path 18.

The sheets III and VI that are conveyed from the image forming apparatus 100 to the cooling conveyance device 98 and pass through the traveling sensor 3 sequentially pass through the traveling sensor 16*a*, the traveling sensor 16*b*, the traveling sensor 16*c*, the traveling sensor 18*a*, the traveling sensor 18*b*, the traveling sensor 18*c*, and the traveling sensor 18*d*.

After the sheet III is stopped for a time 4*t* in the state of being detected by the traveling sensor 16*a* and the traveling sensor 16*b*, the sheet III continues to be conveyed through the cooling path 11. After the sheet VI is stopped for a time 4*t* in the state of being detected by the traveling sensor 16*b* and the traveling sensor 16*c*, the sheet VI is continuously conveyed through the cooling path 11.

FIG. 16 is a diagram that illustrates a relation between the ratio of a sheet detecting time and the ratio of a sheet non-detecting time for each traveling sensor in a case where the timing chart illustrated in FIG. 15 is employed. In a case where sheets are sequentially conveyed without any interruption, as illustrated in FIG. 16, the ratio between the sheet detecting time and the sheet non-detecting time of the traveling sensor 3 arranged in the cooling conveying path and the traveling sensor 18*a*, the traveling sensor 18*b*, the traveling sensor 18*c*, and the traveling sensor 18*d* is 4:1 (80%:20%), which is the same as that illustrated in the timing chart of FIG. 9. Accordingly, heat accumulated in the cooling path for a time 4*t* is dissipated for a time t.

The ratio between the sheet detecting time and the sheet non-detecting time of the traveling sensor 14*b*, the traveling sensor 15*b*, and the traveling sensor 16*b* is 8:7 (53.3%:46.7%). Accordingly, the heat dissipating effect of the branched cooling path increases by 33.3% from that of a case where branching is not performed. Therefore, compared to the case illustrated in FIG. 10 in which branching is not performed, the cooling effect of the metal plate can be maintained relatively well.

In addition, the ratio between the sheet detecting time and the sheet non-detecting time of the traveling sensor 14*a*, the traveling sensor 14*c*, the traveling sensor 15*a*, the traveling sensor 15*c*, the traveling sensor 16*a*, and the traveling sensor 16*c* is 12:18 (40%:60%).

Accordingly, the heat dissipating effect of the branched cooling path increases by 40% from that of a case where branching is not performed. Therefore, compared to the case where branching is not performed, the cooling effect of the metal plate can be maintained relatively well. In addition, the time during which heat is accumulated in the cooling path is lengthened to a time 12*t* from a time 4*t* of the case where branching is not performed, and accordingly, it can be understood that the cooling effect of a sheet is higher than that of the case where branching is not performed.

In addition, when a sheet passes through any one of the branched cooling path 7, the branched cooling path 8, and the branched cooling path 9, the stop time is 4*t*, and the passing time is 29*t*. This is a value increased by a time 4*t* as compared with the case where branch is not performed (a case where a sheet is not stopped). Accordingly, the sheet is cooled for a time increased by 4*t* (21% up) as compared with the case where branching is not performed, and accordingly, the cooling effect of a sheet through the metal plate is high.

In addition, the ratio between the sheet detecting time and the sheet non-detecting time of the traveling sensor 18*d* is 4:1 (80%:20%), and the sheet non-detecting time is a time t, which is the same as that of the traveling sensor 3. Accordingly, the productivity is not lowered.

Furthermore, as in FIG. 15, by changing the stop position for each sheet, the sheets are not stopped at the same position, and accordingly, compared to the case illustrated in FIG. 13, the sheets can be cooled by using the entire cooling path. As can be understood by comparing the traveling sensors 14*a* and 14*c* illustrated in FIGS. 14 and 16 with each other, the sheet non-detecting time of the traveling sensor 14*a* rises to 60% from 46.7%. On the other hand, the sheet non-detecting time of the traveling sensor 14*c* is lowered to 60% from 73.3%. The change in the numeric value represents that the sheet is cooled by using the entire cooling path.

In addition, the metal plate is cooled by the external air, and accordingly, in a case where the temperature of the metal plate decreases to some degrees, even when the cooling time is lengthened (even when the sheet non-detecting time is lengthened), it does not have much influence on the improvement of the cooling capability. Accordingly, even in a case where the sheet non-detecting time decreases to 60% from 73.3%, when the sheet non-detecting time corresponding to 60% is sufficient for cooling the metal plate using the external air, the metal plate can sufficiently cool the sheet.

Cooling Conveyance Operation in Case Where Switching to Branched Cooling Path is Performed (Conveying Path 4)

Figure 17:
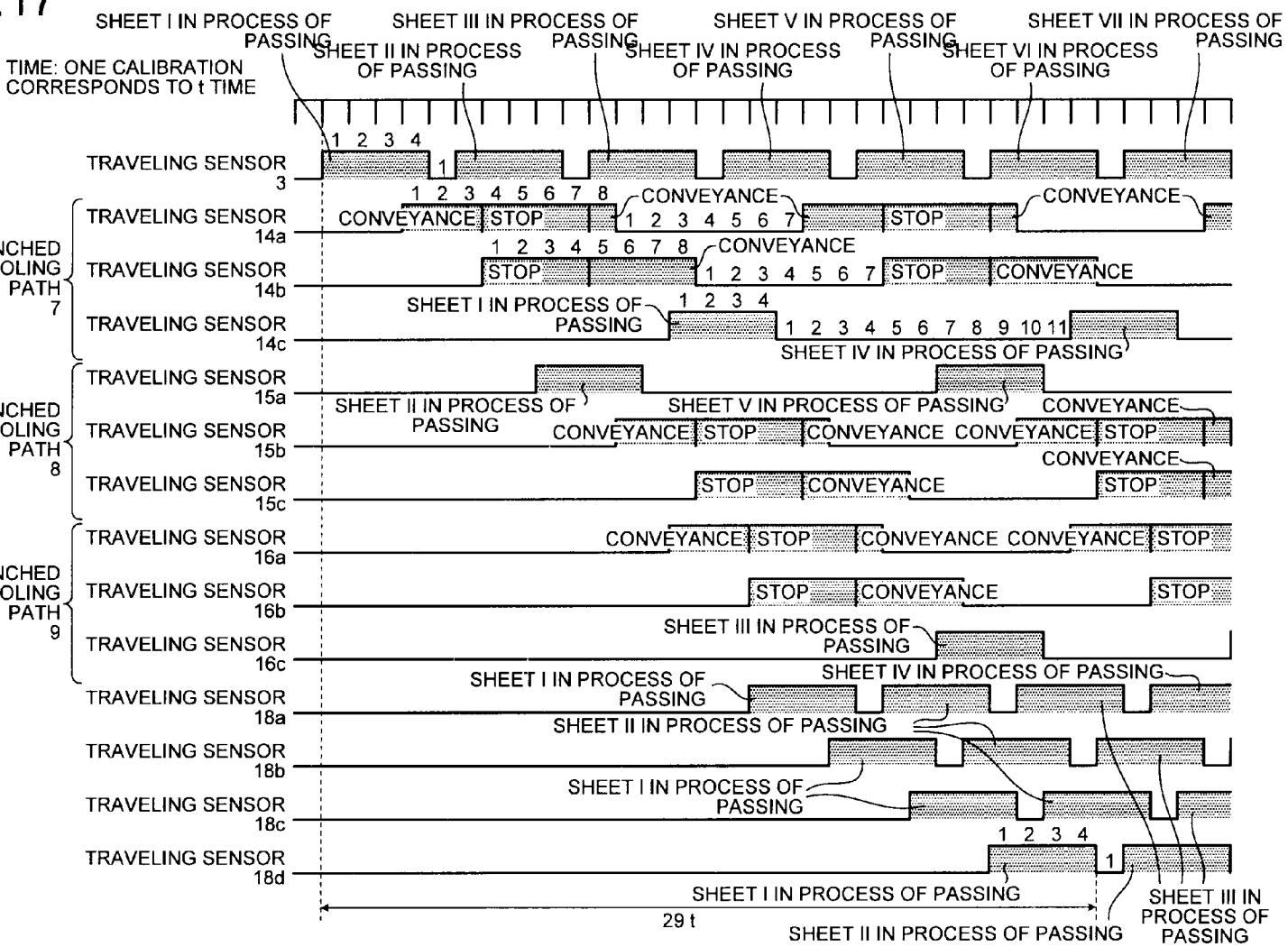
FIG. 17 is an example of a timing chart diagram of a sheet detecting time and a sheet non-detecting time in a case where sheets of adjacent branched cooling paths are stopped for a time 4*t* at different positions.

FIG. 17 illustrates a timing chart of a sheet detecting time and a sheet non-detecting time in a case where sheets of adjacent branched cooling paths are stopped for a time 4*t* at different positions. In other words, the cooling conveyance device 98 stops sheets for a time 4*t* between the traveling sensors 14*a* and 14*b* and 16*a* and 16*b* in the branched cooling path 7 and the branched cooling path 9 and stops a sheet for a time 4*t* between traveling sensors 15*b* and 15*c* in the branched cooling path 8.

In addition, in the branched cooling path 7 and the branched cooling path 9, sheets are stopped for a time 4*t* between the traveling sensors 14*b* and 14*c* and the traveling sensors 16*b* and 16*c*, and in the branched cooling path 8, a sheet can be stopped for a time 4*t* between the traveling sensors 15*a* and 15*b*.

The cooling conveyance device 98 sequentially distributes sheets, one by one, to the three branched cooling paths 7 to 9.

Out of sheets conveyed to the cooling conveyance device 98, sheets I and IV passing through the traveling sensor 3 sequentially pass through the traveling sensor 14*a*, the traveling sensor 14*b*, the traveling sensor 14*c*, the traveling sensor 18*a*, the traveling sensor 18*b*, the traveling sensor 18*c*, and the traveling sensor 18*d*.

After the sheets I and IV are stopped for a time 4*t* in the state of being detected by the traveling sensor 14*a* and the traveling sensor 14*b*, the sheets I and IV are continuously conveyed on the traveling sensor 14*c* and the cooling path 11.

The sheets II and V passing through the traveling sensor 3 sequentially pass through the traveling sensor 15*a*, the traveling sensor 15*b*, the traveling sensor 15*c*, the traveling sensor 18*a*, the traveling sensor 18*b*, the traveling sensor 18*c*, and the traveling sensor 18*d*.

After the sheets II and V pass through the traveling sensor 15*a*, the sheets II and V are stopped for a time 4*t* in the state of being detected by the traveling sensor 15*b* and the traveling sensor 15*c* and then are continuously conveyed on the cooling path 11.

As above, since the branched cooling path 7 and the branched cooling path 8 are adjacent to each other, by not stopping the sheets at the same position viewed from the entrance, the cooling effect of the branched cooling paths 7 and 8 can be improved.

The sheets III and VI passing through the traveling sensor 3 sequentially pass through the traveling sensor 16*a*, the traveling sensor 16*b*, the traveling sensor 16*c*, the traveling sensor 18*a*, the traveling sensor 18*b*, the traveling sensor 18*c*, and the traveling sensor 18*d*.

After the sheets III and VI are stopped for a time 4*t* in the state of being detected by the traveling sensor 16*a* and the traveling sensor 16*b*, the sheets III and VI pass through the traveling sensor 16*c* and are continuously conveyed on the cooling path 11.

Since the branched cooling path 8 and the branched cooling path 9 are adjacent to each other, by not stopping the sheets at the same position viewed from the entrance, the cooling effect of the branched cooling paths 8 and 9 can be improved.

FIG. 18 is a diagram that illustrates a relation between the ratio of a sheet detecting time and the ratio of a sheet non-detecting time for each traveling sensor in a case where the timing chart illustrated in FIG. 17 is employed. In a case where sheets are sequentially conveyed without any interruption, as illustrated in FIG. 18, the ratio between the sheet detecting time and the sheet non-detecting time of the traveling sensor 3 arranged in the conveying path 5 and the traveling sensor 18*a*, the traveling sensor 18*b*, the traveling sensor 18*c*, and the traveling sensor 18*d* is 4:1 (80%:20%), which is the same as that illustrated in FIG. 10. In other words, in the conveying path 5 and the cooling path 11, heat accumulated in the cooling path for a time 4*t* is dissipated for a time t.

The ratio between the sheet detecting time and the sheet non-detecting time of the traveling sensor 14*a*, the traveling sensor 14*b*, the traveling sensor 15*b*, the traveling sensor 15*c*, the traveling sensor 16*a*, and the traveling sensor 16*b* is 8:7 (53.3%:46.7%). This represents that the heat dissipating effect of the branched cooling paths 7 to 9 is increased by 26.7% from a case where branching is not performed. Accordingly, compared to the case where branching is not performed, the cooling effect of the metal plate can be maintained well.

In addition, the ratio between the sheet detecting time and the sheet non-detecting time of the traveling sensor 14*c*, the traveling sensor 15*a*, and the traveling sensor 16*c* is 4:11 (26.7%:73.3%). This represents that the heat dissipating effect of the branched cooling paths 7 to 9 is increased by 53.3% from the case where branching is not performed. Accordingly, compared to the case where branching is not performed, the cooling effect of the metal plate can be maintained well.

The ratio between the sheet detecting time and the sheet non-detecting time of the traveling sensor 18*d* is 4:1 (80%:20%). The sheet non-detecting time is a time t, which is the same as that of the traveling sensor 3. Accordingly, it can be understood that the productivity is not lowered.

In addition, the sheet is stopped for a time 4*t*, and accordingly, even when the sheet passes through any one of the branched cooling path 7, the branched cooling path 8, and the branched cooling path 9, the sheet passing time is 29*t*. Accordingly, the sheet is cooled for a time increased by 4*t* (21% up) as compared with the case where branching is not performed, and accordingly, it can be understood that the cooling effect of a sheet is higher than that of the case where branching is not performed.

In addition, when the traveling sensors 14*a* to 14*c* and the traveling sensors 16*a* to 16*c* illustrated in FIGS. 14 and 18 are compared with each other, the sheet non-detecting time is the same. Also for the traveling sensors 15*a* to 15*c*, when the traveling sensors 15*b* and 15*c*, the traveling sensors 15*a* and 15*b*, and the traveling sensors 15*a* and 15*c* are compared with each other, the sheet non-detecting time is the same.

While the three branched cooling paths 7 to 9 are cooled by the air intake pans, in consideration of the difficulty of the air in passing through a space in which the metal plates are densely disposed, by changing the stop position of the sheet 20 between the branched cooling paths 7 to 9 that are adjacent to each other, as illustrated in FIG. 17, it is difficult for heat to remain in the branched cooling paths 7 to 9, whereby the branched cooling paths can be efficiently cooled.

Control Sequence

Figure 19:
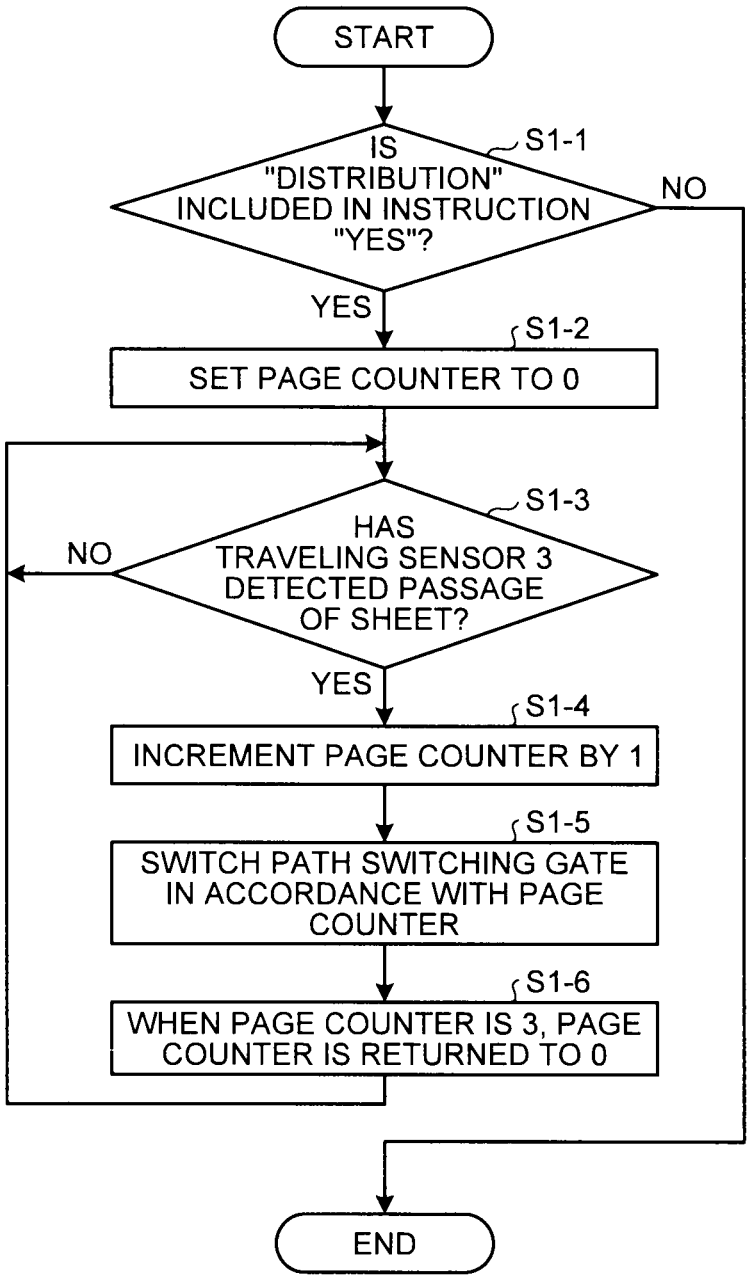
FIG. 19 is an example of a flowchart diagram illustrating the sequence that a cooling conveyance device controls a path switching gate.
Figure 20:
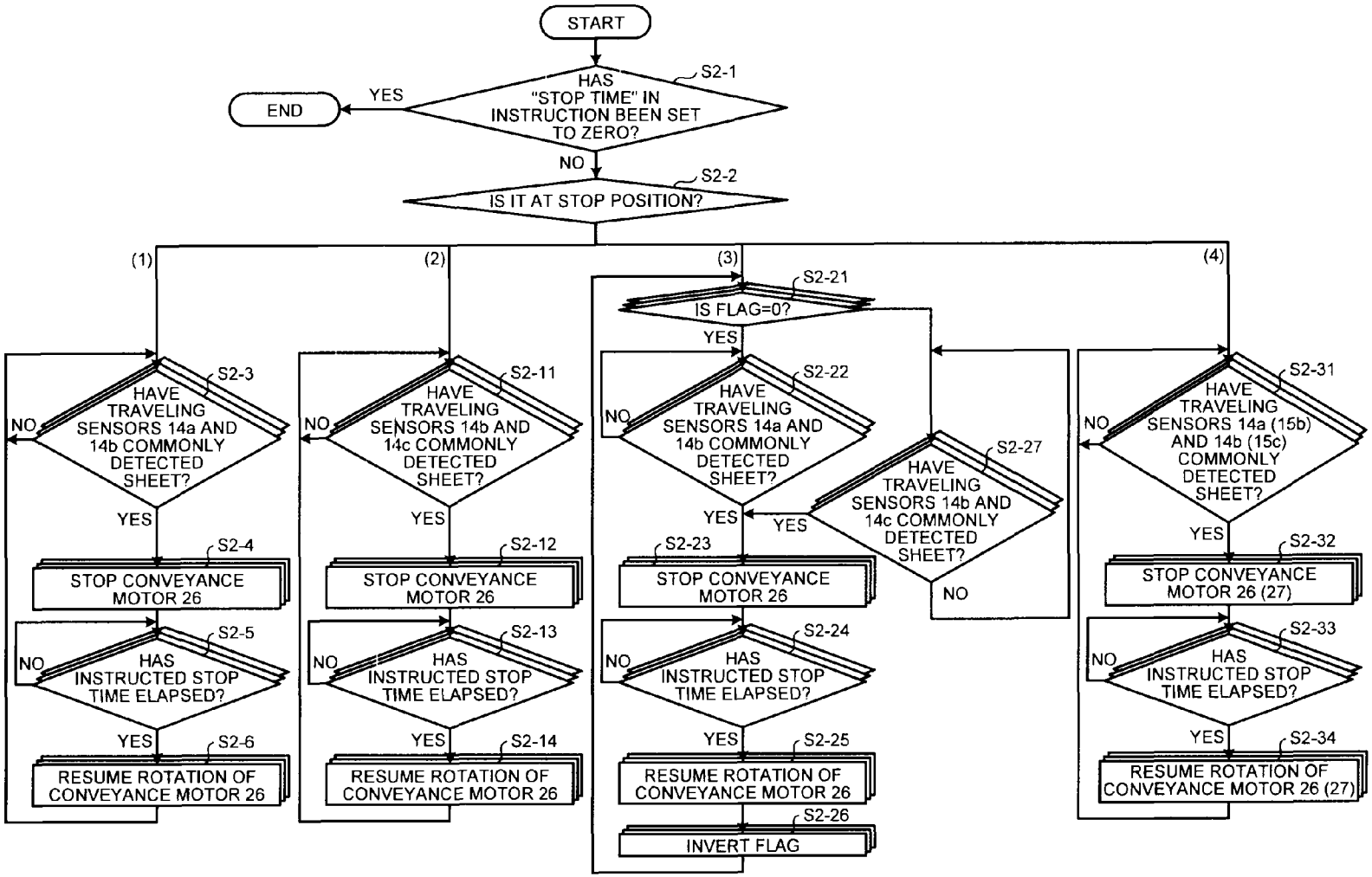
FIG. 20 is an example of a flowchart diagram illustrating the sequence that the cooling conveyance device controls a conveyance motor.

FIG. 19 is an example of a flowchart diagram illustrating the sequence in which the cooling conveyance device 98 controls the path switching gate 6, and FIG. 20 is an example of a flowchart diagram illustrating the sequence in which the cooling conveyance device 98 controls the conveyance motors 26, 27, and 28. The processes illustrated in FIGS. 19 and 20 are performed in parallel.

The sequence illustrated in FIGS. 19 and 20 is started, for example, as the cooling conveyance device 98 receives an instruction for cooling conveyance together with a print start signal from the image forming apparatus 100.

First, the gate switching control unit 64 determines whether or not "distribution" is "Yes" in the instruction for cooling conveyance in Step S1-1. In a case where "distribution" is "No" in the instruction for cooling conveyance (No in Step S1-1), the gate switching control unit 64 does not need to change the connection destination of the path switching gate 6, and accordingly, the process illustrated in FIG. 19 ends.

In such a case, the gate switching control unit 64 switches, for each print job, among the branched cooling paths 7 to 9 or fixes the connection destination of the path switching gate 6 to one of the branched cooling paths 7 to 9 that is randomly determined, and notifies the conveyance motor control unit 63 of the branched cooling path 7, 8, or 9 as the connection destination. Accordingly, the conveyance motor control unit 63 may control only one of the conveyance motors 26, 27, and 28 of one branched cooling path, and whereby the power consumption and the noises can be suppressed.

In contrast, in a case where "distribution" is "Yes" in the instruction for cooling conveyance (Yes in Step S1-1), in order to sequentially change the branched cooling path as the connection destination of the path switching gate 6, the gate switching control unit 64 initializes the page counter to "0" in Step S1-2.

Then, the gate switching control unit 64 determines whether or not the passage of a sheet is detected by the traveling sensor 3 in Step S1-3. As the leading edge of a sheet passes through the traveling sensor 3, the gate switching control unit 64 can detect that the path switching gate 6 needs to be changed. In a case where the passage of the leading edge of the sheet is not detected by the traveling sensor 3 (No in Step S1-3), the process of Step S1-3 is repeated.

In a case where the leading edge of the sheet passes through the traveling sensor 3 (Yes in Step S1-3), the CPU 48 detects the passage based on the occurrence of an interrupt or the like from the traveling sensor 3, and the gate switching control unit 64 increments the page counter by one in Step S1-4.

Then, the gate switching control unit 64 switches the connection destination of the path switching gate 6 to one of the branched cooling paths 7 to 9 in accordance with the value of the page counter in Step S1-5. For example, the program 52 is defined such that switching to the branched cooling path 7 is made in a case where the value of the page counter is "1", switching to the branched cooling path 8 is made in a case where the value of the page counter is "2", and switching to the branched cooling path 9 is made in a case where the value of the page counter is "3".

By performing such a control process, the connection destination of the path switching gate 6 can be sequentially switched to the branched cooling paths 7 to 9 every time a sheet passes through the traveling sensor 3.

Then, when the page counter is three, the gate switching control unit 64 returns the page counter to zero in Step S1-6 and repeats the processes of Step S1-3 and after that.

While the gate switching control unit 64 switches the path switching gate 6, the conveyance motor control unit 63 controls the conveyance motors 26 to 29 in a parallel manner as shown in FIG. 20.

First, the conveyance motor control unit 63 determines whether or not "stop time" included in the instruction for cooling conveyance is zero in Step S2-1. When the stop time is zero (Yes in Step S2-1), it represents no stop, and thus the process illustrated in FIG. 20 ends.

In contrast, in a case where the stop time is not zero (No in Step S2-1), the conveyance motor control unit 63 distributes the process in accordance with the stop position (1), (2), (3), or (4) in Step S2-2.

In a case where the stop position is (1), the conveyance motor control unit 63 stops a sheet between the traveling sensor 14*a* and the traveling sensor 14*b* of the branched cooling path 7, between the traveling sensor 15*a* and the traveling sensor 15*b* of the branched cooling path 8, and between the traveling sensor 16*a* and the traveling sensor 16*b* of the branched cooling path 9.

Accordingly, the conveyance motor control unit 63 determines whether or not both traveling sensors 14*a* and 14*b* have detected the sheet in Step S2-3. After an interrupt occurs from the traveling sensor 14*a*, the CPU 48 determines the detection based on the occurrence of an interrupt or the like from the traveling sensor 14*b*.

In a case where both the traveling sensors 14*a* and 14*b* have detected a sheet (Yes in Step S2-3), the conveyance motor control unit 63 stops the conveyance motor 26 in Step S2-4. The conveyance motor control unit 63 starts to measure the stop time.

Then, the conveyance motor control unit 63 determines whether or not the instructed stop time has elapsed in Step S2-5.

In a case where the stop time has elapsed (Yes in Step S2-5), the conveyance motor control unit 63 resumes the rotation of the conveyance motor 26 in Step S2-6.

As above, the sheet can be stopped between the traveling sensors 14*a* and 14*b* for the instructed stop time on the branched cooling path 7.

In addition, the stop of the sheet between the traveling sensors 15*a* and 15*b* of the branched cooling path 8 and the stop of the sheet between the traveling sensors 16*a* and 16*b* of the branched cooling path 9 are similarly controlled.

In a case where the stop position is (2) in Step S2-2, the control sequence is similar to that of the case of the stop position (1), and the only difference is the stop position. In other words, in a case where the stop position is (2), the conveyance motor control unit 63 stops a sheet between the traveling sensors 14*b* and 14*c* of the branched cooling path 7, between the traveling sensors 15*b* and 15*c* of the branched cooling path 8, and between the traveling sensors 16*b* and 16*c* of the branched cooling path 9.

Accordingly, the conveyance motor control unit 63 determines whether or not both traveling sensors 14*b* and 14*c* have detected the sheet in Step S2-11. After an interrupt occurs from the traveling sensor 14*b*, the CPU 48 determines the detection based on the occurrence of an interrupt or the like from the traveling sensor 14*c*.

In a case where both the traveling sensors 14*b* and 14*c* have detected a sheet (Yes in Step S2-11), the conveyance motor control unit 63 stops the conveyance motor 26 in Step S2-12. The conveyance motor control unit 63 starts to measure the stop time.

Then, the conveyance motor control unit 63 determines whether or not the instructed stop time has elapsed in Step S2-13.

In a case where the stop time has elapsed (Yes in Step S2-13), the conveyance motor control unit 63 resumes the rotation of the conveyance motor 26 in Step S2-14.

As above, the sheet can be stopped between the traveling sensors 14*b* and 14*c* for the instructed stop time on the branched cooling path 7.

In addition, the stop of the sheet between the traveling sensors 15*b* and 15*c* of the branched cooling path 8 and the stop of the sheet between the traveling sensors 16*b* and 16*c* of the branched cooling path 9 are similarly controlled.

The stop position (3) is a stop position at which the stop position (1) and the stop position (2) are switched in each one of the branched cooling paths 7 to 9 for each sheet. Accordingly, the conveyance motor control unit 63 switches the stop position (1) and the stop position (2) based on a flag. This flag is disposed in each one of the branched cooling paths 7 to 9. In a case where the flag is "0", it represents stopping at the stop position (1), in a case where the flag is "1", it represents stopping at the stop position (2). In addition, the initial state of the flag is "0".

The conveyance motor control unit 63 determines whether or not the flag is zero in Step S2-21. In a case where the flag is zero (Yes in Step S2-21), the sheet is stopped at the stop position (1), and the process performed thereafter is similar to that of a case of the stop position (1).

In other words, the conveyance motor control unit 63 determines whether or not both traveling sensors 14*a* and 14*b* have detected the sheet in Step S2-22. After an interrupt occurs from the traveling sensor 14*a*, the CPU 48 determines the detection based on the occurrence of an interrupt from the traveling sensor 14*b* or the like.

In a case where both the traveling sensors 14*a* and 14*b* have detected a sheet (Yes in Step S2-22), the conveyance motor control unit 63 stops the conveyance motor 26 in Step S2-23. The conveyance motor control unit 63 starts to measure the stop time.

Then, the conveyance motor control unit 63 determines whether or not the instructed stop time has elapsed in Step S2-24.

In a case where the stop time has elapsed (Yes in Step S2-24), the conveyance motor control unit 63 resumes the rotation of the conveyance motor 26 in Step S2-25.

Then, in order to switch the stop positions of the next sheet, the conveyance motor control unit 63 inverts the flag in Step S2-26. Accordingly, when the flag is "0", it is inverted to "1", and when the flag is "1", it is inverted to "0".

In a case where the flag is not zero in Step S2-21 (No in Step S2-21), the sheet is stopped at the stop position (2), and accordingly, the process performed thereafter is similar to that of a case of the stop position (2).

In a case where both the traveling sensors 14*b* and 14*c* have detected a sheet (Yes in Step S2-27), the conveyance motor control unit 63 stops the conveyance motor 26, resumes the rotation thereof after the stop time elapses, and inverts the flag.

In addition, the stop of the sheet between the traveling sensors 15*a* and 15*b* of the branched cooling path 8 and the stop of the sheet between the traveling sensors 16*a* and 16*b* of the branched cooling path 9 are similarly controlled.

The stop position (4) is a stop position at which the stop positions of adjacent branched cooling paths out of the branched cooling paths 7 to 9 are differently set. Accordingly, the conveyance motor control unit 63 may perform a control process similar to that of the stop position (1) in the branched cooling paths 7 and 9 and perform a control process similar to that of the stop position (2) in the branched cooling path 8.

The conveyance motor control unit 63 determines whether or not both traveling sensors 14*a* and 14*b* have detected the sheet in Step S2-31. After an interrupt occurs from the traveling sensor 14*a*, the CPU 48 determines the detection based on the occurrence of an interrupt from the traveling sensor 14*b* or the like.

In a case where both the traveling sensors 14*a* and 14*b* have detected a sheet (Yes in Step S2-31), the conveyance motor control unit 63 stops the conveyance motor 26 in Step S2-32. The conveyance motor control unit 63 starts to measure the stop time.

Then, the conveyance motor control unit 63 determines whether or not the instructed stop time has elapsed in Step S2-33.

In a case where the stop time has elapsed (Yes in Step S2-33), the conveyance motor control unit 63 resumes the rotation of the conveyance motor 26 in Step S2-34. The stop of the sheet between the traveling sensors 16*a* and 16*b* of the branched cooling path 9 is similarly controlled.

In the branched cooling path 8, the stop position of the sheet is between the traveling sensors 15*b* and 15*c*. Accordingly, the control sequence is the same as that of the case of the stop position (2). The conveyance motor control unit 63 determines whether or not both traveling sensors 15*b* and 15*c* have detected the sheet. After an interrupt occurs from the traveling sensor 15*b*, the CPU 48 determines the detection based on the occurrence of an interrupt from the traveling sensor 15*c* or the like.

In a case where both the traveling sensors 15*b* and 15*c* have detected a sheet, the conveyance motor control unit 63 stops the conveyance motor 26. The conveyance motor control unit 63 starts to measure the stop time.

Then, the conveyance motor control unit 63 determines whether or not the instructed stop time has elapsed.

In a case where the stop time has elapsed, the conveyance motor control unit 63 resumes the rotation of the conveyance motor 26. As above, in the branched cooling paths that are adjacent to each other, the positions at which the sheets are stopped can be changed.

As described above, the cooling conveyance device 98 according to this embodiment includes a plurality of the branched cooling paths 7 to 9 for which the passing time of a sheet is the same, and by sequentially setting the branched cooling paths 7 to 9 as the conveying path for each sheet, the cooling capability can be markedly increased without lowering the productivity.

In addition, by temporarily stopping the sheet, the cooling capability is further increased, and there is a plurality of the branched cooling paths 7 to 9, whereby, compared to a case where there is one cooling path, a decrease in the productivity can be greatly suppressed.

Second Embodiment

In the cooling conveyance device 98 according to the first embodiment, although the branched cooling paths 7 to 9 are sequentially set as the conveying path for each sheet, a plurality of the branched cooling paths 7 to 9 is disposed in a limited space, and accordingly, even when the external air taken in from the air intake fan 24 is brought into contact with the metal plate, there may be a branched cooling path having a low heat dissipating effect out of the branched cooling paths 7 to 9 due to the heat dissipating of adjacent branched cooling paths 7 to 9.

In other words, in the case illustrated in FIG. 3, an ideal case is assumed in which the wind of the air intake fan 24 is uniformly blown to the plurality of the branched cooling paths 7 to 9. However, actually, the branched cooling path 8, which is located in the middle, having both sides to be adjacent to the branched cooling path 7 and the branched cooling path 9 also dissipates heat of the branched cooling paths 7 and 9 located on both sides, and accordingly, the heat dissipating effects of the branched cooling paths 7 to 9 may be different from one another. In addition, for the presence of the cooling path 11, the heat dissipating effects of the branched cooling paths 7 to 9 may be different from one another.

In such a case, according to a method in which the conveying path is changed every time the sheet is input, in a case where there is a difference in the heat dissipating effects of the conveying paths, it is difficult to acquire uniform heat dissipating effects.

In addition, the conditions for the size of a sheet and the type of sheet (a coated sheet, an envelope, and the like) need to be considered. In other words, since there are differences in the heat dissipating effects of the branched cooling paths 7 to 9 based on the size of a sheet, the size of a sheet and the type of sheet need to be considered as a condition for determining whether to perform the operation of switching among the conveying paths. In addition, since there is a difference in the heat dissipating effects in accordance with the size of sheet, a method of switching between the conveying paths may be selected.

Thus, in the cooling conveyance device 98 according to the second embodiment, when sheets are sequentially conveyed to the cooling conveyance device 98, as a criterion for not decreasing the cooling effect of a conveying path having a low heat dissipating effect out of a plurality of conveying paths and for selecting a method of controlling switching among the conveying paths in which the cooling effect of a conveying path having a low heat dissipating effect is not decreased, the size of sheets and the type of sheets are considered.

The cooling conveyance device 98 according to the second embodiment, similarly to that according to the first embodiment, has a configuration in which the cooling path is branched into the plurality of branched cooling paths 7 to 9, the path switching gate 6 switching the sheet conveying paths of the plurality of branched cooling paths 7 to 9 is included, and the exits of the plurality of branched cooling paths 7 to 9 are joined to the same conveying path. According to the cooling conveyance device 98 of the second embodiment, in a case where sheets are sequentially conveyed to the cooling conveyance device without any interruption, in controlling of switching among the plurality of conveying branched cooling paths 7 to 9, the number of sheets to be distributed is set for each conveying path in accordance with the degree of easiness of heat dissipating of the plurality of branched cooling paths 7 to 9, and, when sheets corresponding to the set number are conveyed, switching among the branched cooling paths 7 to 9 is performed. Accordingly, the ratio of sheet conveyance to the branched cooling path 7, 8 or 9 that cannot easily dissipate heat is decreased, whereby it is possible to recover the cooling effect by increasing the heat dissipating effect of the accumulated heat.

The configuration of an image forming system according to the second embodiment, a schematic configuration of the cooling conveyance device 98, the stop positions of sheets 20 in the branched cooling paths 7 to 9, the hardware configuration of a controller of the image forming apparatus 100, the configuration of a control unit of the cooling conveyance device 98, and the functional configuration of the cooling conveyance device 98 and the image forming apparatus 100 are similar to those according to the first embodiment described with reference to FIGS. 2, 3, 4A to 4F, 5, 6, and 7.

Figure 21:
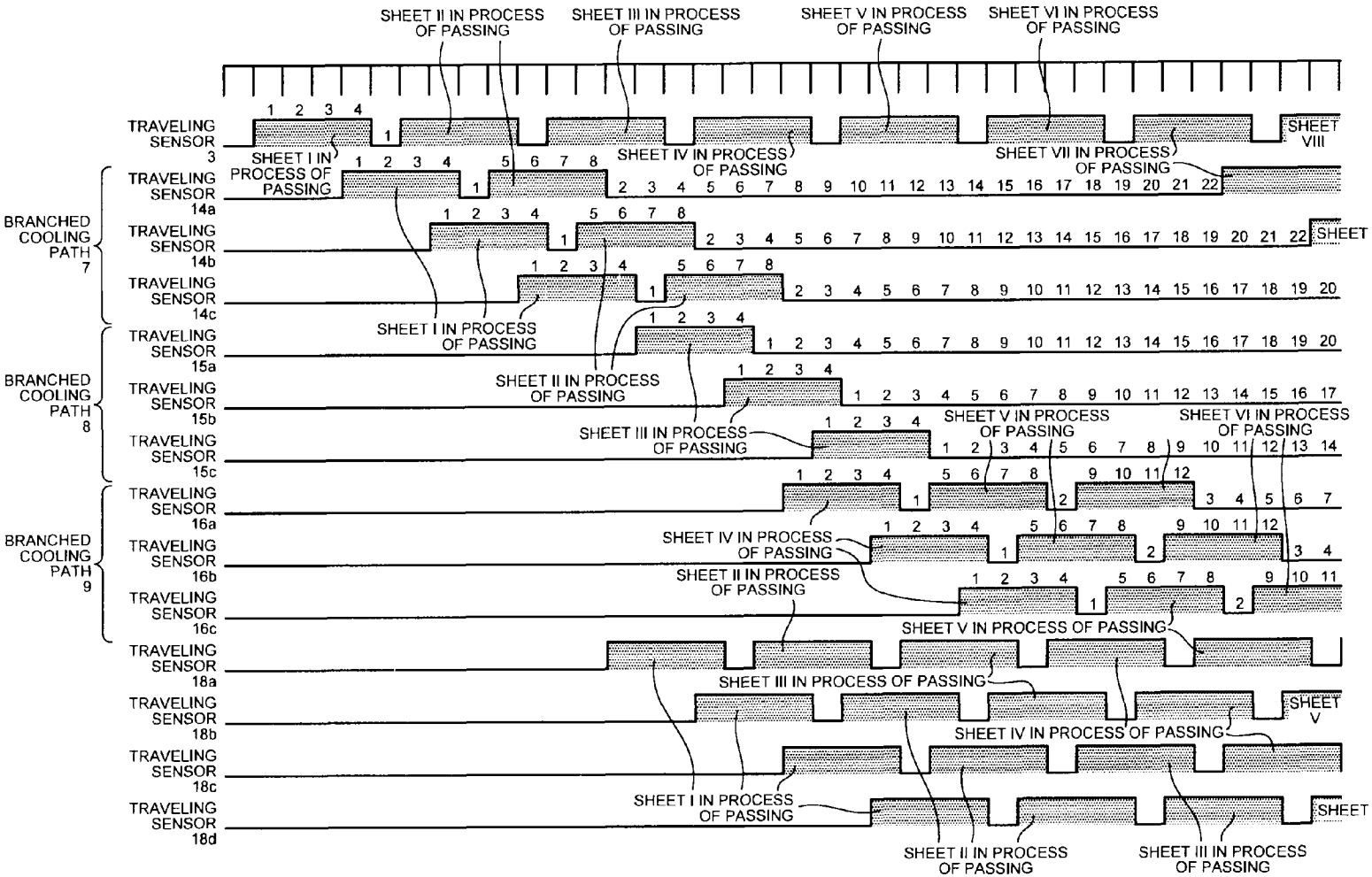
FIG. 21 is a timing chart of a sheet detecting time and a sheet non-detecting time according to a second embodiment.

FIG. 21 is a timing chart of a sheet detecting time and a sheet non-detecting time in the cooling conveyance device 98 according to the second embodiment in an example in which the sheet distribution ratio D1 that is a ratio for distributing sheets to the branched cooling paths 7 to 9 is set as {branched cooling path 7: branched cooling path 8: branched cooling path 9}={2:1:3 }.

In the example illustrated in FIG. 21, there is an influence of the heat dissipating effect of an adjacent branched cooling path, and accordingly, the heat dissipating effect of the branched cooling path 8 is lower than those of the branched cooling paths 7 and the branched cooling path 9 since the branched cooling path 8 is influenced by the heat dissipating effects of the branched cooling path 7 and the branched cooling path 9, and the heat dissipating effect of the branched cooling path 9 is higher than that of the branched cooling path 7 due to no presence of a conveying path on one side. Accordingly, the sheet distribution ratio D1 is determined in consideration of the differences in the heat dissipating effects of the branched cooling paths 7 to 9.

In other words, in the cooling conveyance device 98 according to the second embodiment, the sheet distribution ratio D1 for the branched cooling paths 7 to 9 is set as "2:1:3" in numerical values in accordance with the levels of the heat dissipating effect. For example, the cooling conveyance device 98 causes one branched cooling path to convey sheets corresponding to the set value for the one branched cooling conveys, and then causes another branched cooling path to convey sheets corresponding to the set value for the other branched cooling path by changing the conveying path.

Here, the sheet distribution ratio D1 is determined by the conveying path determining unit 67 of the image forming apparatus 100 based on the size of a sheet and the type of sheet such as a coated sheet or an envelope and is included in path switching data to be described later. Other than being set as the ratio of sheets to be distributed to the branched cooling paths 7 to 9, the sheet distribution ration D1 may be set as the number of sheets that are actually conveyed to the branched cooling paths 7 to 9 consistent with the ratio.

In addition to the sheet distribution ratio, the conveying path determining unit 67 of the image forming apparatus 100 determines a page counter switching number D2 and the number D3 of sheets for which the page counter is returned to "0" and sets the numbers D2 and D3 as the path switching data. The path switching data is transmitted to the cooling conveyance device 98 by the communication unit 65 of the image forming apparatus 100.

The sheet distribution ratio D1 may be stored in a memory or the like arranged in the image forming apparatus 100 in advance or may be configured such that a user inputs the sheet distribution ratio so as to be set for the image forming apparatus 100.

In FIG. 21, a sheet detecting time in each traveling sensor is represented by applying shading thereto, and a sheet non-detecting time in each traveling sensor 14, 15, 16, or 18 is represented without applying shading thereto. The sheet detecting time is a time during which sheets are cooled by the branched cooling paths 7 to 9 and the cooling path 11, and heat is accumulated in the branched cooling paths 7 to 9 and the cooling path 11. In addition, the sheet non-detecting time is a time during which the heat accumulated in the branched cooling paths 7 to 9 and the cooling path 11 is dissipated.

Since the sheet passing time is constant regardless of switching to the branched cooling paths 7 to 9, the sheet passing time of the case illustrated in FIG. 21 is a time 25*t* that is the same as that of a case illustrated in FIG. 9. The sheet passing time is a time during which a sheet is cooled by the cooling conveyance device 98.

The cooling conveyance device 98 conveys sheets corresponding to numbers acquired by representing the heat dissipating effect in numeric value to each of three branched cooling paths 7 to 9.

As is illustrated in the traveling sensor 3 in a time series, sheets I to VI are sequentially conveyed to the cooling conveyance device 98 from the image forming apparatus 100. Here, sheets I and II are distributed to the branched cooling path 7, a sheet III is distributed to the branched cooling path 8, and sheets IV, V, and VI are distributed to the branched cooling path 9.

The sheets I and II that have passed through the traveling sensor 3 sequentially pass through the traveling sensor 14*a*, the traveling sensor 14*b*, the traveling sensor 14*c*, the traveling sensor 18*a*, the traveling sensor 18*b*, the traveling sensor 18*c*, and the traveling sensor 18*d*.

The sheet III that has passed through the traveling sensor 3 sequentially passes through the traveling sensor 15*a*, the traveling sensor 15*b*, the traveling sensor 15*c*, the traveling sensor 18*a*, the traveling sensor 18*b*, the traveling sensor 18*c*, and the traveling sensor 18*d*.

The sheets IV, V, and VI that have passed the traveling sensor 3 sequentially pass through the traveling sensor 16*a*, the traveling sensor 16*b*, the traveling sensor 16*c*, the traveling sensor 18*a*, the traveling sensor 18*b*, the traveling sensor 18*c*, and the traveling sensor 18*d*.

FIG. 22 is a diagram that illustrates the relation between the ratio of a sheet detecting time and the ratio of a sheet non-detecting time for each traveling sensor in a case where the timing chart illustrated in FIG. 21 is employed. In a case where sheets are sequentially conveyed without any interruption, as illustrated in FIG. 22, the ratio between the sheet detecting time and the sheet non-detecting time of the traveling sensor 3 arranged in the conveying path 5 and the traveling sensor 18*a*, the traveling sensor 18*b*, the traveling sensor 18*c*, and the traveling sensor 18*d* arranged in the cooling path 11 is 4:1 (80%:20%), which is the same as that illustrated in FIG. 10. Accordingly, in the conveying path 5 and the cooling path 11, heat accumulated in the cooling path 11 for a time 4*t* is dissipated for a time t.

In contrast to this, the ratio between the sheet detecting time and the sheet non-detecting time of the traveling sensor 14*a*, the traveling sensor 14*b*, and the traveling sensor 14*c* arranged in the branched cooling path 7 is 8:22 (26.7%:73.3%). In addition, the ratio between the sheet detecting time and the sheet non-detecting time of the traveling sensor 15*a*, the traveling sensor 15*b*, and the traveling sensor 15*c* arranged in the branched cooling path 8 is 4:26 (13.3%:86.7%).

The ratio between the sheet detecting time and the sheet non-detecting time of the traveling sensor 16*a*, the traveling sensor 16*b*, and the traveling sensor 16*c* arranged in the branched cooling path 9 is 12:18 (40%:60%). In addition, even when a sheet passes through any one of the branched cooling path 7, the branched cooling path 8, and the branched cooling path 9, the sheet passing time remains as 25*t*.

When compared with the case illustrated in FIG. 9, the sheet non-detecting time increases from 20% to 73.3% in the branched cooling path 7, and accordingly, the heat dissipating effect of the branched cooling path increases from the state illustrated in FIG. 9 by 53.3%. In addition, the sheet non-detecting time increases from 20% to 86.7% in the branched cooling path 8, and accordingly, the heat dissipating effect of the branched cooling path increases from the state illustrated in FIG. 9 by 66.7%. The sheet non-detecting time increases from 20% to 60% in the branched cooling path 9, and accordingly, the heat dissipating effect of the branched cooling path increases from the state illustrated in FIG. 9 by 40%. Accordingly, compared to the case where sheets are not distributed as illustrated in FIG. 9, the cooling effect of sheets from the conveying path 5 to the cooling path 11 can maintained well.

In the example illustrated in FIG. 11, the sheet non-detecting ratio is the same in the branched cooling path 8, the branched cooling path 7, and the branched cooling path 9. In contrast, in the example illustrated in FIG. 22, when aligned in the order of higher sheet non-detecting ratios, there are the branched cooling path 8, the branched cooling path 7, and the branched cooling path 9 in the above-described order. This is a result by distributing sheets in accordance with the heat dissipating effects of the branched cooling paths in the example illustrated in FIG. 22.

The ratio between the sheet detecting time and the sheet non-detecting time of the traveling sensors 18*a*, 18*b*, 18*c*, and 18*d* of the branched cooling path 8 is 4:1 (80%:20%). The sheet non-detecting time is a time t, which is the same as that of the traveling sensor 3. Accordingly, it can be checked that the productivity is the same as that of a case where branching is not performed and does not decrease at all.

Therefore, according to the second embodiment illustrated in FIGS. 21 and 22, even in a case where the heat dissipating effects of the branched cooling paths are different from one another, when sheets are sequentially conveyed without any interruption in a state in which heat can be easily accumulated, the sheets can be expected to be sufficiently cooled.

When sheets are sequentially conveyed without any interruption, the image forming apparatus 100 instructs the cooling conveyance device 98 to perform cooling conveyance at the sheet distribution ratio D1 illustrated in FIG. 21 in accordance with a combination of a plurality of conditions (a combination of the type of sheet, the thickness of the sheet, the set fixing temperature, the interior temperature and humidity, and the length of a conveying path from the image forming apparatus 100 to the loading unit) or one or more conditions described above.

Figure 23:
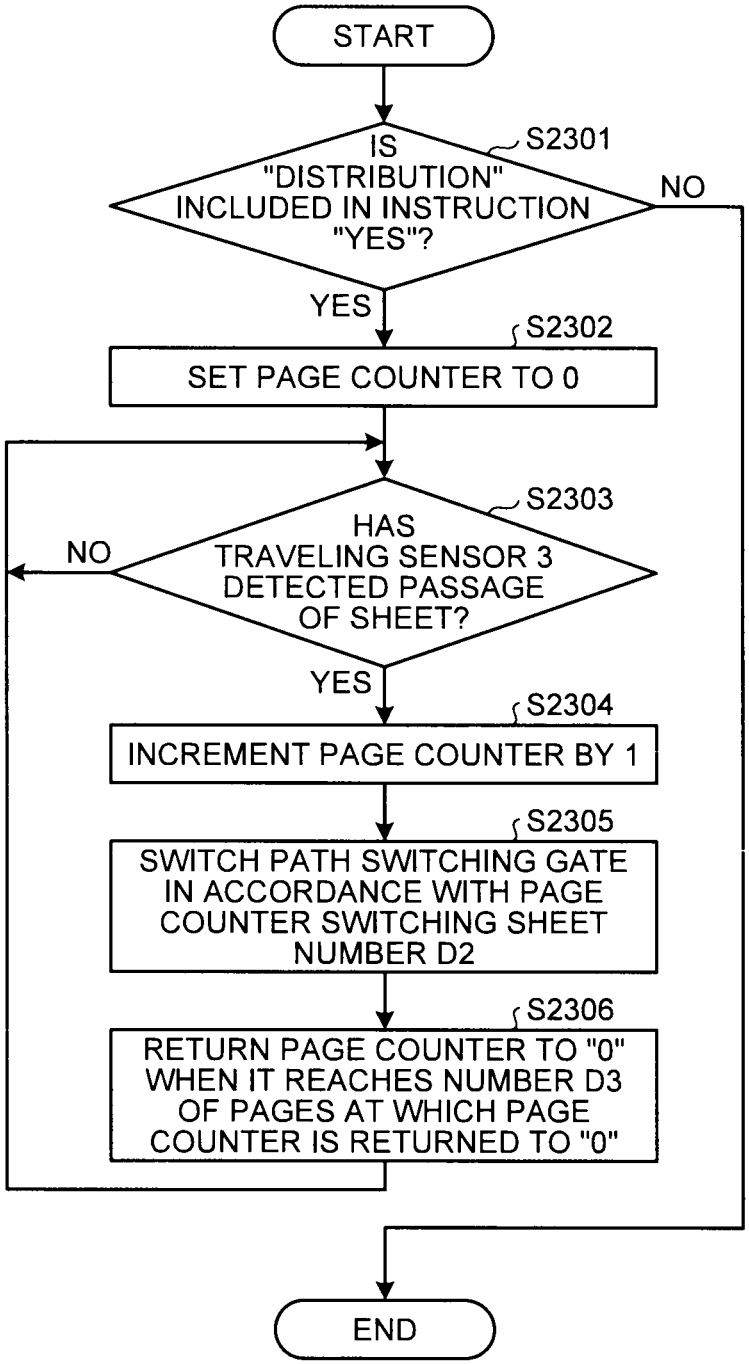
FIG. 23 is a flowchart illustrating the sequence of a switching control process of a path switching gate according to the second embodiment.

Next, the switching control of the path switching gate performed by the cooling conveyance device 98 according to this embodiment will be described. FIG. 23 is a flowchart illustrating the sequence of a switching control process of a path switching gate according to the second embodiment. Also in this embodiment, the switching control process of the path switching gate is started, for example, as the cooling conveyance device 98 receives an instruction for cooling conveyance together with a print start signal from the image forming apparatus 100.

First, the gate switching control unit 64 determines whether or not "distribution" is "Yes" in the instruction for cooling conveyance in Step S2301. In a case where "distribution" is "No" in the instruction for cooling conveyance (No in Step S2301), the gate switching control unit 64 does not need to change the connection destination of the path switching gate 6, and accordingly, the process illustrated in FIG. 23 ends.

In contrast, in a case where "distribution" is "Yes" in the instruction for cooling conveyance (Yes in Step S2301), in order to sequentially change the branched cooling path as the connection destination of the path switching gate 6, the gate switching control unit 64 initializes the page counter to "0" in Step S2302.

Then, the gate switching control unit 64 determines whether or not the passage of a sheet is detected by the traveling sensor 3 in Step S2303. In a case where the passage of the leading edge of the sheet is not detected by the traveling sensor 3 (No in Step S2303), the process of Step S2303 is repeated.

In Step S2303, although the traveling sensor 3 is set as a starting point, information indicating that a sheet is conveyed from the image forming apparatus 100 may be set as the starting point.

In a case where the leading edge of the sheet passes through the traveling sensor 3 (Yes in Step S2303), the CPU 48 detects the passage based on the occurrence of an interrupt from the traveling sensor 3 or the like, and the gate switching control unit 64 increments the page counter by one in Step S2304.

Then, the gate switching control unit 64 switches the connection destination of the path switching gate 6 to one of the branched cooling paths 7 to 9 in accordance with the page counter switching sheet number D2 included in the path switching data received from the image forming apparatus 100 in Step S2305.

FIG. 24 is a schematic diagram illustrating an example of the path switching data. This path switching data is generated by the conveying path determining unit 67 of the image forming apparatus 100 and is transmitted to the cooling conveyance device 98. As illustrated in FIG. 24, the path switching data is registered such that the sheet distribution ratio D1 and the page counter switching sheet number D2 are associated with each other for each one of the branched cooling paths 7 to 9.

The sheet distribution ratio D1, as described above, is a ratio for distributing sheets to the branched cooling paths 7 to 9. In the example illustrated in FIG. 24, the sheet distribution ratio D1, similarly to the example illustrated in FIGS. 21 and 22, is set as "branched cooling path 7: branched cooling path 8: branched cooling path 9"=2:1:3.

The page counter switching sheet number D2 is a counting value of the page counter that is operational timing for switching the connection destination of the path switching gate 6 to one of the branched cooling paths 7 to 9. In the example illustrated in FIG. 24, the page counter switching sheet number D2 of the branched cooling path 7 is set to "1", the page counter switching sheet number D2 of the branched cooling path 8 is set to "3", and the page counter switching sheet number D2 of the branched cooling path 9 is set to "4".

In Step S2305, when the value of the page counter reaches the page counter switching sheet number D2, the connection destination of the path switching gate 6 is switched to one of the branched cooling paths 7 to 9. In the example of the path switching data illustrated in FIG. 24, the program 52 is defined such that switching to the branched cooling path 7 is made when the value of the page counter reaches "1", switching to the branched cooling path 8 is made when the value of the page counter reaches "3", and switching to the branched cooling path 9 is made when the value of the page counter reaches "4".

The number D3 for which the page counter is returned to "0" is the number of sheets for which the page counter is initialized to "0". In the example illustrated in FIG. 24, "6" is set as the number D3 for which the page counter is returned to "0". In the example illustrated in FIG. 24, the number D3 for which the page counter is returned to "0" is a value that is acquired by summing the sheet distribution ratios D1 of the branched cooling paths.

Note that the path switching data illustrated in FIG. 24 is an example, and thus, in the path switching data, a plurality of data values of the sheet distribution ratios D1, the page counter switching sheet numbers D2, and the numbers D3 for which the page counter is returned to "0" may be set in accordance with the sheet size, the type of sheet, the thickness of the sheet, and other conditions.

Referring back to FIG. 23, after the process of Step S2305, when the value of the page counter is the number D3 for which the page counter is returned to "0", the gate switching control unit 64 returns the page counter to "0" in Step S2306, and the process of Step S2303 and after that is repeated.

As above, according to this embodiment, in a case where sheets are sequentially conveyed to the cooling conveyance device 98 without any interruption, in the control of switching to one of a plurality of branched cooling paths 7 to 9, the number of sheets to be distributed is set for each conveying path in accordance with the degree of easiness of heat dissipating of the plurality of branched cooling paths 7 to 9, and, when sheets corresponding to the set number of sheets are conveyed, switching among the branched cooling paths 7 to 9 is performed. Accordingly, the ratio of sheet conveyance to the branched cooling path 7, 8 or 9 that cannot easily dissipate heat is decreased, whereby it is possible to recover the cooling effect by increasing the heat dissipating effect of the accumulated heat.

According to the present invention, there can be provided a conveying device, a print system, and a method of cooling a sheet that are capable of suppressing a decrease in the productivity or the cooling effect even in a case where sheets are sequentially conveyed to the conveyance device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying device that conveys a sheet discharged from an image forming apparatus, the sheet conveying device comprising:

an air intake fan that takes in external air;

an air exhaust fan that discharges internal air;

a plurality of branched conveying paths which are branched from a conveying path within a range from a sheet entrance to a sheet exit and for which a passing time of the sheet is approximately the same;

a conveyance motor that independently conveys the sheet to each one of the branched conveying paths;

a conveying path switching unit that switches among the branched conveying paths; and a conveying path control unit that causes the conveying path switching unit to sequentially switch among the branched conveying paths every time the sheet is input from the image forming apparatus.

2. The sheet conveying device according to claim 1, further comprising a conveyance motor control unit that causes the conveyance motor to stop the sheet on each branched conveying path for an approximately same time.

3. The sheet conveying device according to claim 2, wherein the conveyance motor control unit selectively stops the sheet at one of a plurality of stop positions in the branched conveying path.

4. The sheet conveying device according to claim 3, wherein the conveyance motor control unit changes the stop position in the branched conveying path every time the sheet passes through the branched conveying path.

5. The sheet conveying device according to claim 3, wherein the conveyance motor control unit stops the sheet on a first branched conveying path at the stop position different from the stop position of a second branched conveying path that is adjacent to the first branched conveying path.

6. The sheet conveying device according to claim 1, wherein, in a case where a thickness of the sheet is a predetermined value or more, the conveying path control unit controls the conveyance switching unit to sequentially switch among the branched conveying paths every time the sheet is input from the image forming apparatus.

7. The sheet conveying device according to claim 1, wherein, in a case where environmental temperature or environmental humidity is a predetermined value or higher, the conveying path control unit causes the conveying path switching unit to sequentially switch among the branched conveying paths every time the sheet is input from the image forming apparatus.

8. The sheet conveying device according to claim 1, wherein, in a case where a fixing temperature of the image forming apparatus is a predetermined value or higher, the conveying path control unit causes the conveying path switching unit to sequentially switch among the branched conveying paths every time the sheet is input from the image forming apparatus.

9. The sheet conveying device according to claim 1, wherein the conveying path control unit causes the conveyance switching unit to fix a branched conveying path on which the sheet input from the image forming apparatus is to be conveyed to one of the branched conveying paths, in response to an instruction transmitted from the image forming apparatus.

10. The sheet conveying device according to claim 1, wherein the conveying path control unit causes the conveying path switching unit to change the branched conveying path after the sheets as many as the number which corresponds to a distribution ratio are conveyed, the distribution ratio being a ratio for distributing the sheets to the branched conveying paths.

11. The sheet conveying device according to claim 1, wherein the conveying path control unit causes the conveyance switching unit to switch among the branched conveying paths based on a size of the sheet.

12. The sheet conveying device according to claim 1, wherein the conveying path control unit causes the conveyance switching unit to switch among the branched conveying paths based on a type of the sheet.

13. A print system comprising:

an image forming apparatus; and a sheet conveying device that conveys a sheet discharged from the image forming apparatus, wherein the sheet conveying device includes:

an air intake fan that takes in external air;

an air exhaust fan that discharges internal air;

a plurality of branched conveying paths which are branched from a conveying path within a range from a sheet entrance to a sheet exit and for which a passing time of the sheet is approximately the same;

a conveyance motor that independently conveys the sheet to each one of the branched conveying paths;

a conveying path switching unit that switches among the branched conveying paths; and a conveying path control unit that causes the conveying path switching unit to sequentially switch among the branched conveying paths every time the sheet is input from the image forming apparatus, and wherein the image forming apparatus includes:

a conveying path determining unit that determines the branched conveying path on which the sheet is to be conveyed; and a transmission unit that transmits an instruction for the determined branched conveying path to the sheet conveying device.

14. The print system according to claim 13, wherein the conveying path determining unit detects one or more devices that are connected to a downstream of the image forming apparatus and determines to fix the branched conveying path on which the sheet is to be conveyed to one of the branched conveying paths in a case where a conveyance distance or a conveyance time in which the sheet is conveyed through the one or more devices is a predetermined value or more.

15. The print system according to claim 13, wherein the conveying path control unit causes the conveying path switching unit to change the branched conveying path after the sheets as many as the number which corresponds to a distribution ratio are conveyed, the distribution ratio being a ratio for distributing the sheets to the branched conveying paths, wherein the conveying path determining unit further sets the distribution ratio, and wherein the transmission unit further transmits the set distribution ratio to the sheet conveying device.

16. The print system according to claim 15, wherein the conveying path determining unit sets the distribution ratio based on a size of the sheet.

17. The print system according to claim 15, wherein the conveying path determining unit sets the distribution ratio based on a type of the sheet.

18. The print system according to claim 15, wherein the conveying path determining unit sets, as the distribution ratio, the number of the sheets that are to be distributed to each one of the branched conveying paths.

19. A sheet cooling method performed in a sheet conveying device that includes: an air intake fan that takes in external air; an air exhaust fan that discharges internal air; a plurality of branched conveying paths which are branched from a conveying path within a range from a sheet entrance to a sheet exit and for which a passing time of the sheet is approximately the same; a conveyance motor that independently conveys the sheet on each one of the branched conveying paths; and a conveying path switching unit that switches among the branched conveying paths, the method comprising:

causing the conveying path switching unit to sequentially switch among the branched conveying paths every time the sheet is input from the image forming apparatus by using a conveying path control unit.

* * * * *